US005764246A

United States Patent [19]

Wataya et al.

[11] Patent Number: 5,764,246

[45] Date of Patent: Jun. 9, 1998

[54] METHOD AND APPARATUS FOR CONTROLLING A PRINTING OPERATON IN ACCORDANCE WITH A TEMPERATURE OF A PRINT HEAD

[75] Inventors: Masafumi Wataya, Kawasaki; Shinji Kanemitsu; Makoto Kashimura, both of Yokohama; Makoto Takemura, Tokyo; Shinya Matsui, Ushiku; Toshiyuki Onishi; Tetsuhiro Nitta, both of Yokohama; Yasuhiro Unosawa; Satoshi Saikawa, both of Tokyo; Masaru Satou, Ushiku; Hiroshi Yoshino, Yokohama, all of Japan

[73] Assignee: Canon Kabushiki Kaisha, Tokyo, Japan

[21] Appl. No.: 910,719

[22] Filed: Aug. 13, 1997

Related U.S. Application Data

[63] Continuation of Ser. No. 724,852, Oct. 3, 1996, abandoned, which is a continuation of Ser. No. 248,514, May 24, 1994, abandoned.

[30] Foreign Application Priority Data

May 27, 1993 [JP] Japan ..... 5-125929
Jun. 25, 1993 [JP] Japan ..... 5-155304

[51] Int. Cl.[6] ..... B41J 2/01

[52] U.S. Cl. ..... 347/14; 347/17; 374/172; 374/178

[58] Field of Search ..... 347/14, 17, 56, 347/67; 374/172, 173, 178; 257/467–470

[56] References Cited

U.S. PATENT DOCUMENTS

| | | | |
|---|---|---|---|
| 4,122,719 | 10/1978 | Carlson | 374/172 X |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,481,596 | 11/1984 | Townzen | 374/172 X |
| 4,558,333 | 12/1985 | Sugitani et al. . | |
| 4,608,577 | 8/1986 | Hori . | |
| 4,660,056 | 4/1987 | Yokoi . | |
| 4,723,129 | 2/1988 | Endo et al. | 347/56 |
| 4,740,796 | 4/1988 | Endo et al. | 347/56 |
| 5,175,565 | 12/1992 | Ishinaga | 347/17 |
| 5,231,423 | 7/1993 | Wataya et al. . | |
| 5,250,957 | 10/1993 | Onozano | 347/37 X |
| 5,401,099 | 3/1995 | Nishizawa | 374/178 |
| 5,485,182 | 1/1996 | Takayanagi et al. | 347/17 |

FOREIGN PATENT DOCUMENTS

| | | | |
|---|---|---|---|
| 0478781 | 4/1992 | European Pat. Off. | B41J 2/01 |
| 0505154 | 9/1992 | European Pat. Off. | B41J 2/07 |
| 0605207 | 7/1994 | European Pat. Off. | B41J 2/05 |
| 54-056847 | 5/1979 | Japan | B41M 5/26 |
| 59-123670 | 7/1984 | Japan | B41J 3/04 |
| 59-138461 | 8/1984 | Japan | B41J 3/04 |
| 60-071260 | 4/1985 | Japan | B41J 3/04 |
| 61-266250 | 11/1986 | Japan | B41J 3/04 |
| 61-290064 | 12/1986 | Japan | B41J 3/04 |
| 62-064561 | 3/1987 | Japan | B41J 3/10 |
| 01290437 | 11/1989 | Japan | B41J 3/04 |
| 03061048 | 3/1991 | Japan | B41J 2/30 |

OTHER PUBLICATIONS

Pöppel, "Measurement of Temperature Gradients at the Heater of a Bubble Jet by Detection of the Nucleation", Society for Information Display International Symposium, *Digest of Technical Papers*, vol. XX, pp. 176–179 and 431, May 1989.

*Primary Examiner*—Joseph W. Hartary
*Attorney, Agent, or Firm*—Fitzpatrick, Cella, Harper & Scinto

[57] ABSTRACT

A printing apparatus has a control unit for controlling the driving of a print head in accordance with a temperature measured by a sensor which is provided on a movable carriage for mounting the print head. The control unit controls a sensor such that the sensor measures the temperature when the carriage is in a position where the heat from motors or the like in the printing apparatus does not affect the sensor on the carriage.

20 Claims, 25 Drawing Sheets

METHOD AND APPARATUS FOR CONTROLLING A PRINTING OPERATON IN ACCORDANCE WITH A TEMPERATURE OF A PRINT HEAD

This application is a continuation of application Ser. No. 08/724,852 filed Oct. 3, 1996, now abandoned, which is a continuation of application Ser. No. 08/248,514 filed May 24, 1994, abandoned.

BACKGROUND OF THE INVENTION

1. Field of the Invention

The present invention relates to controlling a printing operation in accordance with a temperature of a print head, and more particularly, to a printing apparatus and method in which the temperature of a print head is measured with high precision and the print head is controlled in accordance with the measured result.

2. Related Background Art

In an ink jet printing apparatus, an ink droplet is discharged from a discharge opening of a print head using thermal energy and a printing medium is printed by the droplet. The ink jet printing apparatus has several advantages such as high speed printing, high resolution, high image quality and low noise output.

The ink in a nozzle of the print head is heated rapidly and the force of film boiling occurring in the ink forces ink to discharge as an ink droplet from the discharge opening of the print head. Therefore, the temperature of the print head influences the stability of the amount of the ink droplet. In a conventional ink jet printing apparatus, an expensive sensor for measuring the temperature of the print head is provided on the print head. The temperature of the print head is controlled on the basis of the measured result in order that the temperature of the print head is maintained within a certain range or an ink discharge recovery operation is controlled on the basis of the measured result. These control methods are called closed-loop control methods.

A drive control of the print head for stable discharging is performed based on the temperature of a heater of the print head for discharge. However, even if the temperature of the heater for discharge is constant, since the temperature of the ink is influenced by ambient temperature, a discharge amount varies in accordance with the ambient temperature. In order to diminish this variation, the print head is driven in accordance with a table in which the combination of the temperature of the ink and the temperature of the heater for discharge are stored such that the discharge amount of the ink is to be the same even if the temperature of the ink changes. Therefore, it is important to detect the ambient temperature of the print head precisely.

FIGS. 2A–2C are schematic cross sectional views for explaining the mechanism of ink jet printing. In FIGS. 2A–2C, reference numeral 201 denotes an ink passage of a print head, reference numeral 202 denotes ink, reference numeral 203 denotes a heater for heating the ink, reference numeral 204 denotes a printing medium such as a paper, reference numeral 205 denotes a bubble formed by heating ink 202 using a heater 203, reference numeral 206 denotes a discharged ink droplet, and reference numeral 207 denotes ink attached on the printing medium 204.

Next, a printing operation will be explained referring to FIG. 2. First, a pulse voltage is supplied from an unshown print head drive circuit to the heater 203 while the print head ink passage 201 is filled with the ink 202. Then, the ink 202 which contacts the heater 203, is heated rapidly and is vaporized, and therefore the bubble 205 is formed. At the same time, the ink existing near the front of the heater 203 is pressurized forward due to the energy of the expanding bubble 205, and, as a result, the ink droplet 206 is discharged from the print head 201.

Ink droplet 206 is thus attached on the printing medium 204, and the printing of characters or image is performed.

In this printing operation, if the size of the ink droplets 206 are nonuniform, poor printing quality due to inconsistency of density or the like will be caused. Therefore, in order to get fine printing quality, it is preferable that the size of the ink droplets are uniform.

However, the size of the ink droplet 206 is influenced by the viscosity of the ink, in other words, by the temperature of the ink. Therefore, in a conventional printing apparatus, the size of the ink droplet 206 is controlled to be uniform by measuring the temperature of the ink and controlling the discharge energy by varying the pulse width of the pulse voltage to be added in accordance with the measured temperature.

As a means for measuring the temperature of ink, a thermistor or a diode is used by disposing it in an unshown ink chamber of the print head communicating with 201.

FIG. 3 shows a characteristic of the aforementioned diode, in which the horizontal axis represents an ambient temperature T(° C.) of the diode, and the vertical axis represents a forward voltage Vf (volts) which is detected when the constant forward current is sent to the diode. However, the diode used in this description of the prior art has the following characteristics.

$Vf$=0.567 $V$±50 mv ($If$=200 $\mu A$, $T$=25° $C$.) variation amount of temperature $\Delta Vf$=−2.37 $mV$ ($If$=200 $\mu A$)

In FIG. 3, reference numeral 301 denotes a curve representing "characteristic of forward voltage and ambient temperature" on a condition that the constant forward current If of 200 μA is sent to the diode to be used for measuring the temperature. According to FIG. 3, it will be understood that as the temperature rises, the forward voltage Vf decreases, and it will also be understood that the forward voltage Vf of this diode at 25° C. is 0.567 V.

In addition, reference numeral 302 denotes a curve representing a "characteristic of forward voltage and ambient temperature" of a diode having a characteristic in which the scatter of forward voltage, on a condition that the constant forward current If of 200 μA is sent to the diode, is higher than that of a standard diode by 20 mV.

Similarly, reference numeral 303 denotes a curve representing a "characteristic of forward voltage and ambient temperature" of a diode voltage having a characteristic in which the scatter of forward voltage, on a condition that the constant forward current If of 200 μA is sent to the diode, is lower than that of the standard diode by 20 mV.

FIG. 4 shows a conventional circuit for measuring the temperature of ink using the diode shown in FIG. 3 having the above characteristics.

In FIG. 4, reference numeral 101 denotes the ink jet print head unit (IJ head), and 64 ink jet head passages shown in FIG. 2 are usually disposed in the IJ head at intervals of 1/300 inch.

Reference numeral 102 denotes the ink temperature measuring means using the above-mentioned diode, and at least one of the measuring means is disposed in the ink chamber of the IJ head.

Reference numeral 103 denotes a constant current circuit for sending constant forward current to the diode 102.

Reference numeral 401 denotes a central processing unit, and it controls and drives the IJ head 101 and various mechanisms when the printing operation is performed.

Reference numeral 402 denotes a input terminal for A/D conversion (analog/digital conversion), and the terminal is connected to an unshown A/D converter which is built in the central processing unit 401, and the inputted voltage value is converted to the digital value by the A/D converter.

Reference numeral 403 denotes a correction data memory for storing the correction data for correcting the scatter of the characteristic of the diode 102 and the memory 403 outputs the correction data to the central processing unit 401 through a signal line 403A. The correction data is classified in a few levels by previously measuring the characteristic of the diode 102 of the IJ head 101.

The correction data can be stored in the correction data memory 403 by using, for example, an unshown panel switch of the printing apparatus or the like during the manufacturing process in a factory.

In case that the IJ head is an exchangeable cartridge, a memory element such as a ROM or some discriminating means is provided in the IJ head, and when the IJ head is mounted in the printing apparatus, the central processing unit 401 can get the correction information from the IJ head.

Next, an operation of the conventional system shown in FIG. 4 will be explained hereinafter.

When an unshown power switch is turned on while the IJ head 101 is mounted in the printing apparatus, the constant current If of 200 μA is supplied to the diode 102 from the constant current circuit 103. The forward voltage Vf of the diode 102 is amplified seven times by the amplifier 104 and is inputted to the A/D input terminal 402 for converting to a digital value and the digital value is converted into the temperature information by the central processing unit 401.

When the central processing unit 401 converts the forward voltage Vf into temperature information, the central processing unit 401 calculates on the basis of the above-mentioned correction data.

FIG. 5 shows a characteristic curve of the relation between temperature and the forward voltage of the diode 102 which is inputted to the central processing unit 401 through the A/D input terminal 402 shown in FIG. 4.

In FIG. 5, reference numeral 501 denotes a characteristic curve when the diode having a standard characteristic is used, and reference numeral 502 denotes a characteristic curve when the diode having a characteristic in which the scatter of forward voltage, on a condition that the constant forward current of 200 μA is applied, is higher than the standard diode by 20 mV, is used. Similarly, reference numeral 503 denotes a characteristic curve when the diode having a characteristic in which the scatter of forward voltage, on a condition that the constant forward current of 200 μA is applied, is lower than the standard diode by 20 mV, is used.

Reference numeral 504 denotes a range of the temperature change characteristic of the diode used in this conventional example. According to FIG. 5, it will be understood that the forward voltage Vf of the diode with the characteristic curve 501 is 3.969 V at 25° C.

However, as understood from the forward voltage characteristic of the diode shown in FIG. 5, actual available data range is only 829.5 mV within +5 V, and therefore the dynamic range of the temperature characteristic changeable area is small. As a result, high resolution in A/D conversion is not fully utilized, for example, only 44 steps within 256 steps can be utilized in 8 bit A/D conversion, and therefore fine temperature measurement cannot be performed.

In addition, since the correction of the scatter in the characteristic of the diode 102 is performed by levels, the degree of precision in correction is low. Moreover, as the correction data is previously determined, there is a possibility of erroneously setting the correction data in the correction data memory 403.

Since the conventional method has the problem described in the foregoing, it has been difficult to measure temperature precisely.

Next, another conventional ink jet printing apparatus will be described hereinafter referring to FIGS. 15 and 16.

FIG. 15 is a perspective view of the other conventional ink jet printing apparatus, and FIG. 16 is a perspective view of a carriage portion of the ink jet printing apparatus.

In FIG. 15, reference numeral 610 denotes a printing medium, and it is placed on a feeder tray 2100. The printing medium 610 is forwarded to a transferring means 611 by a forwarding means which is driven by an unshown drive source. Next, the printing medium 610 is transferred in the direction of arrow A shown in FIG. 15 through a printing medium discharge means 612.

Reference numeral 603 denotes a carriage which mounts an unshown print head and an ink cartridge 602 (in FIG. 15, four ink cartridges are mounted), and the carriage scans in the direction of arrows B and C driven by a CR motor 2203 though a belt 620.

On the carriage 603, there are provided a rotatable head cover 604 and a cartridge cover 605 for fixing the print head and the ink cartridge 602 to the carriage 603.

FIG. 16 is a perspective view of the carriage portion in FIG. 15 seen in the direction of arrows D—D, and it shows the relation of a linear scale 608 and a reading element 609.

Reference numeral 621 in FIG. 16 denotes a cable for transmitting a drive signal to the print head on the carriage 603. Reference numeral 606 denotes a guide axis along which the carriage 603 can move. Reference numeral 607 denotes a support surface which supports and guides one end of the carriage 603. Reference numeral 608 denotes the linear scale extending along the scanning direction of the carriage 603.

In FIG. 16, reference numeral 601 denotes the print head which discharges ink droplets utilizing thermal energy for printing an image on a printing medium, and the print head is in communication with the ink cartridge 602 through an ink path.

The reading element 609 generates a synchronized signal based on the position of the carriage 603. In this example, the reading element 609 comprises an MR element which reads magnetically.

The linear scale 608 is a rod-like structure, and a magnetic pattern is recorded on a magnetic portion formed on the surface of the linear scale 608 in a recording pitch density corresponding to, for example, 180 dots per inch (dpi) or 360 dpi. By using a combination of the linear scale 608 with reading element 609, it is possible to detect the position of the moving carriage 603.

The printing operation is performed controlling the print head 601 in a certain drive timing, and the drive timing is synchronized with the detected position of the carriage 603. The above-mentioned magnetic reading method is particularly suitable for a printing apparatus capable of fine printing, because the magnetic pattern can be recorded on the linear scale 608 in a pitch ranging from 360 dpi to 600 dpi.

Reference numeral 2201 denotes a carriage base for amplifying the signal which is generated by the reading element 609. Reference numeral 2202 denotes a temperature sensor such as a thermistor provided on the carriage base 201.

The above-mentioned guide axis 606, the support surface 607 and the end portion of the linear scale 608 are affixed to both sides of the housing 614 of the printing apparatus and also supported by the supporting member 613 respectively. The supporting member 613 has a fulcrum for rotation associated with the housing 614, and therefore the supporting member 613 can rotate on the housing 614.

Reference numeral 2132 denotes an operation lever which extends from the supporting member 613. Reference numeral 2300 denotes a microswitch which is fixed on the housing 614 and is disposed such that the microswitch 2300 can be turned on or off in accordance with the position of the lever 2132.

The conventional structure is thus constructed, and the ambient temperature of the print head 601 is measured by the temperature sensor 2202 provided on the carriage base 2201.

However, the above-mentioned example has the following problems.

There are many parts of the apparatus which radiate heat, such as a CR motor for moving the carriage, a LF motor for transferring the printing medium, a power source, a base or the like inside the actual printing apparatus. As a result, those parts influence the temperature inside the printing apparatus. The ambient temperature rises to 80° C. when a certain kind of motor is used. Particularly, the CR motor for moving the carriage which mounts the print head is inevitably disposed being close to the carriage.

In this situation, when the measuring of the temperature is performed while the carriage is close to the CR motor, due to the radiation of heat from the CR motor, the ambient temperature rises, and as a result, accurate measurement of temperature cannot be performed.

In the above-mentioned conventional printing apparatus, the CR motor 2203 is positioned close to the carriage base 2201, that is, a position where the CR motor 2203 faces the carriage base 2201 with the housing 614 interposed therebetween. Therefore, due to the radiation of heat from the CR motor 2203, the ambient temperature of the carriage base 2201 rises, and as a result, the measured value of temperature includes an error.

Since the temperature of ink is presumed to be the same as the ambient temperature, if the ambient temperature is measured to be higher than the actual temperature, an error in the actual temperature of ink in the print head 602 occurs. As a result, the drive control of the print head becomes unstable and inconsistency in an amount of discharged ink results.

SUMMARY OF THE INVENTION

The present invention is designed to overcome the above problems in the conventional structures. It is accordingly an object of the present invention to provide an ink jet printing apparatus and method capable of driving a print head on the basis of the precisely measured temperature of the print head.

In accordance with one aspect of the present invention, an ink jet printing apparatus for printing an image on a printing medium using printing means having a first temperature measuring means, is provided. The apparatus comprises:

second temperature measuring means having a degree of precision higher than that of the first temperature measuring means, correction condition determining means for determining a condition to correct an output of said first temperature measuring means such that the output of the first temperature measuring means is substantially the same as that of the second temperature measuring means, correction means for correcting the output of the first temperature measuring means in accordance with the correction condition determined by the correction condition determining means, and control means for controlling the printing means in accordance with the output of said first temperature measuring means corrected by the correction means.

In accordance with another aspect of the present invention, an ink jet printing method for printing an image on a printing medium using printing means having a first temperature measuring means is provided. The method comprises the steps of providing second temperature measuring means having a degree of precision higher than that of the first temperature measuring means, determining a condition to correct an output of the first temperature measuring means such that the output of said first temperature measuring means is substantially the same as that of the second temperature measuring means, correcting the output of the first temperature measuring means in accordance with the correction condition determined in the correction condition determining step, and controlling the printing means in accordance with the corrected output of the first temperature measuring means.

In accordance with still another aspect of the present invention, an ink jet printing apparatus for printing an image on a printing medium using printing means having a temperature measuring means is provided. The apparatus comprises subtracting means for subtracting a predetermined value from an output of the temperature measuring means, an amplifier for amplifying the subtracted output of the temperature measuring means, and control means for controlling the printing means in accordance with the amplified value amplified by the amplifier.

In accordance with a further aspect of the present invention, an ink jet printing method for printing an image on a printing medium using printing means having a temperature measuring means is provided. The method comprises the steps of subtracting a predetermined value from an output of the temperature measuring means, amplifying the subtracted output of the temperature measuring means, and printing by controlling the printing means in accordance with the amplified value.

In accordance with yet further aspect of the present invention, an ink jet printing apparatus for printing an image on a printing medium using printing means is provided. The apparatus comprises moving means for moving the printing means relatively to the printing medium, temperature measuring means for measuring ambient temperature and which moves with the printing means, and control means for controlling the printing means in accordance with an output of the temperature measuring means when the temperature measuring means is within a predetermined range which is shorter than a full moving range of the printing means.

In accordance with yet another aspect of the present invention, an ink jet printing method for printing an image on a printing medium using printing means is provided. The method comprises the steps of providing temperature measuring means for measuring ambient tempeature and which moves with the printing means and printing by controlling the printing means in accordance with an output of the temperature measuring means when the temperature measuring means is within a predetermined range which is shorter than a full moving range of the printing means.

DETAILED DESCRIPTION OF THE PREFERRED EMBODIMENTS

Embodiments of the printing apparatus according to the present invention will be described in detail with reference to the accompanying drawings.

In the following embodiments, like the conventional printing apparatus, as the printing apparatus, an ink jet serial-type printing apparatus will be described.

Figure 1:
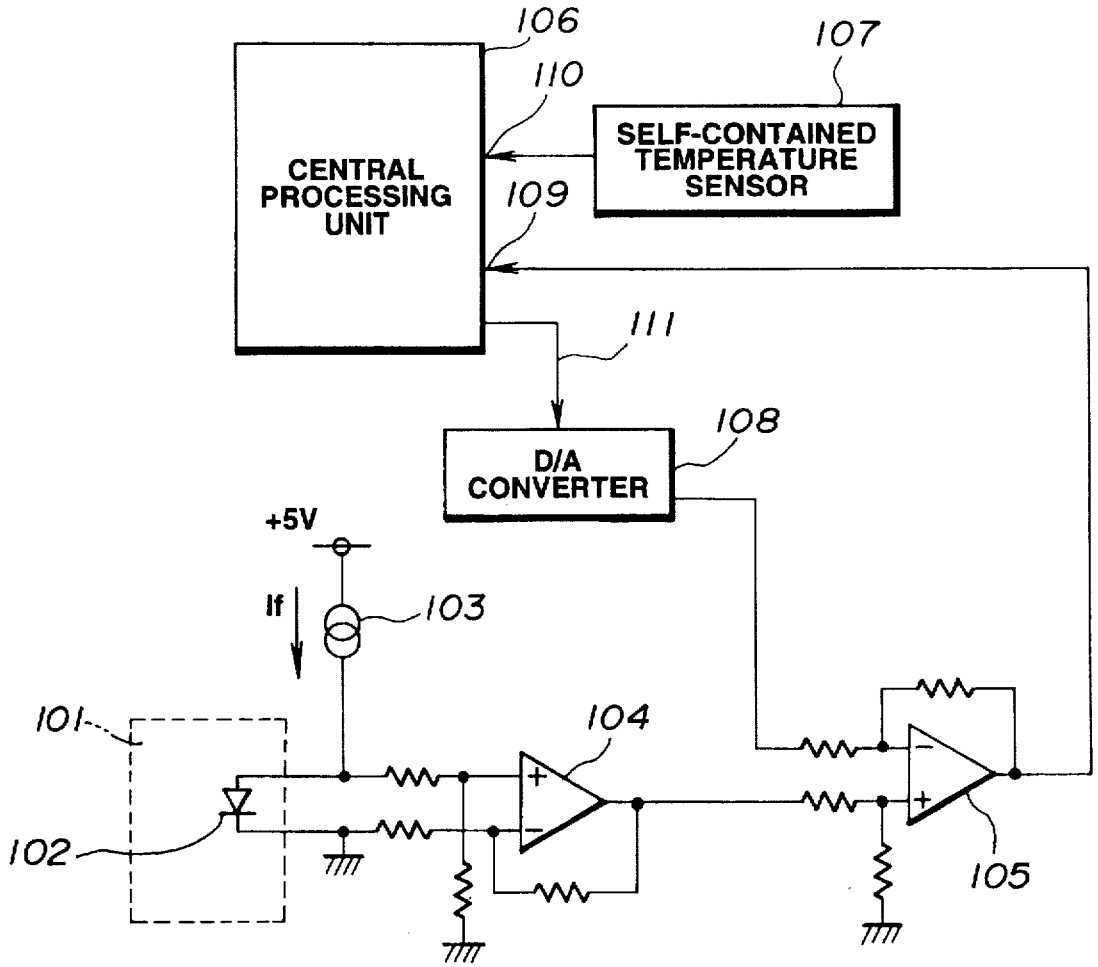
FIG. 1 is a schematic block diagram for explaining a first embodiment of the present invention.
Figure 2A:
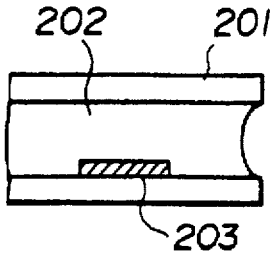
FIG.2A PRIOR ART
FIGS. 2A–2C are schematic views showing the principle of the ink discharge according to the ink jet printing method.
Figure 2B:
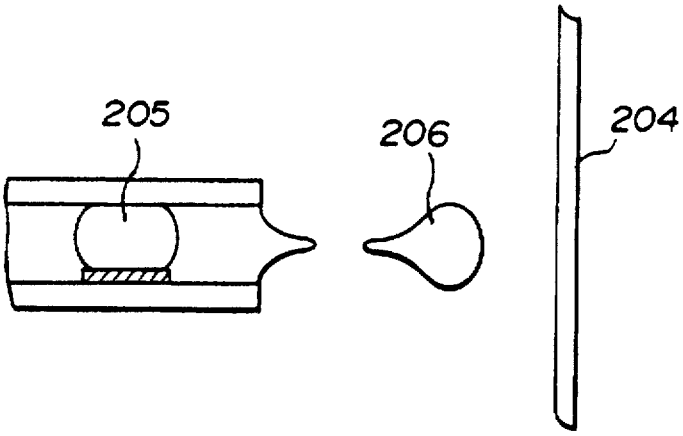
FIG.2B PRIOR ART
Figure 2C:
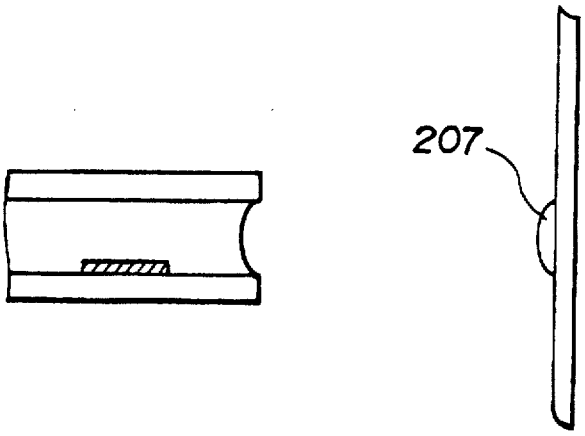
FIG.2C PRIOR ART
Figure 3:
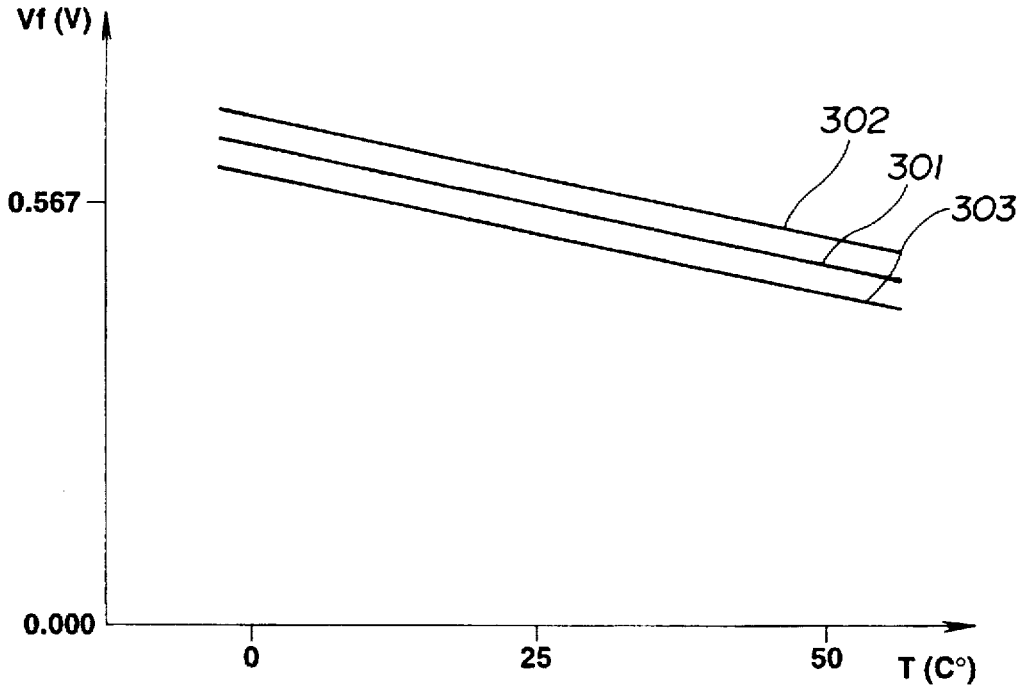
FIG. 3 is a graph showing the characteristic of the forward voltage and the temperature of a diode.
Figure 4:
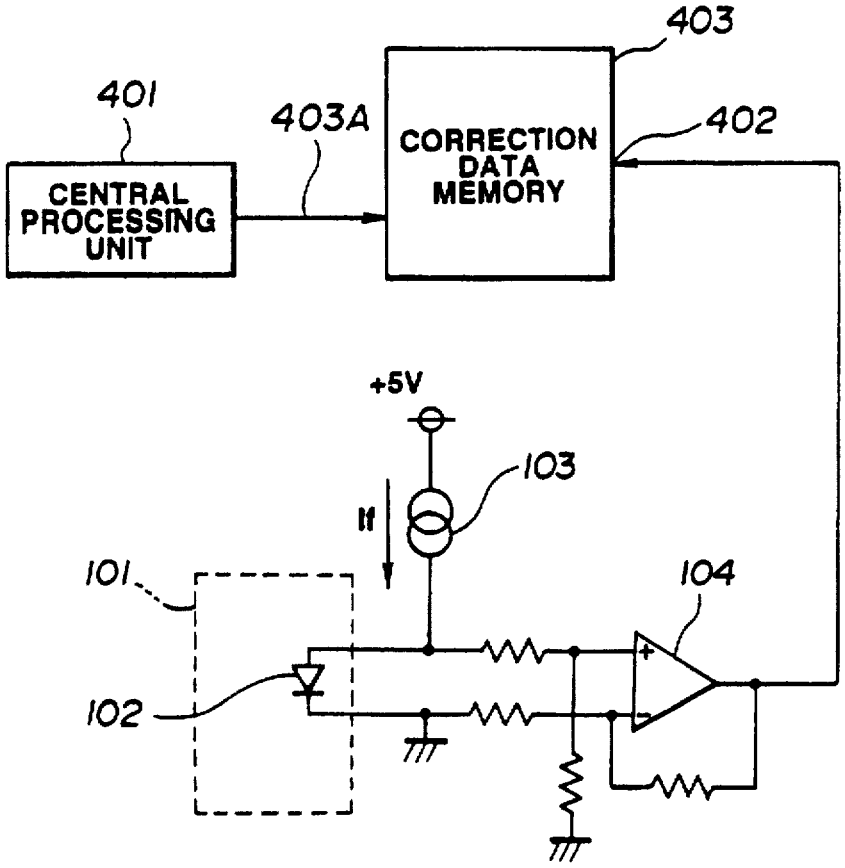
FIG.4 PRIOR ART
FIG. 4 is a schematic block diagram for explaining a conventional printing apparatus.

FIG. 1 shows as schematic block diagram of the first embodiment of the present invention. In FIG. 1, reference numerals 101, 102, 103 and 104 denote respectively the IJ head, the diode for measuring temperature, the constant current circuit and the amplifier whose gain in seven times as explained in the description of the related background art.

Reference numeral 105 denotes an amplifier for taking off the portion of the forward voltage Vf of the diode 102 which is not influenced by temperature and magnifying the dynamic range of the portion of the forward voltage vf of the diode 102 which is influenced by temperature, and the is amplifier has a gain of 2.86 times.

Reference numeral 106 denotes a central processing unit which controls mechanisms to be used in a printing operation and controls IJ head 101.

Reference numeral 107 denotes a self-contained temperature sensor, and a thermometer whose degree of precision to measure temperature is higher than the diode sensor is used as the temperature sensor 107 in this embodiment. It is preferable that the temperature sensor 107 is provided as close as possible to the print head. For example, the sensor 107 can be provided on the carriage. Reference numeral 108 denotes a D/A converter (digital/analog converter) for outputting an analog voltage value, controlled by the central processing unit 105.

Both of references 109 and 110 are input terminals for A/D conversion (analog/digital conversion), and the terminal are electrically connected to an unshown A/D converter which is built in the central processing unit 106 whereby the voltage value inputted from the terminals is converted to a digital value.

Reference numeral 111 denotes a control line by which processing unit 106 controls the D/A converter 108.

The operation of this embodiment will be described hereinafter according to the above-mentioned construction.

Under the condition in which the IJ head 101 is installed in the body of the printing apparatus, and an unshown power switch of the printing apparatus is turned on, a constant current If of 200 μA is supplied to the diode 102 from the constant current circuit 103. Then, the forward voltage Vf of the diode 102 is amplified seven times by the first amplifier 104 and inputted to the non-reserved input terminal of the second amplifier.

On the other hand, a voltage corresponding to the correct data for the diode 102 is outputted from the D/A converter 108 to the reverse input terminal of the second amplifier 105, so that a voltage value which is calculated by amplifying the value which is calculated by subtracting the output value of the D/A converter 108 from the output value of the amplifier 104 (that is the value which is calculated by subtracting the area which is not influenced by temperature from the forward voltage Vf of the diode 102) by 2.86 times using the amplifier 105, is inputted to the input terminal 109 for A/D conversion of the central processing unit 106. The amplified voltage value is the voltage value which is generated by magnifying the dynamic range of the voltage portion which is influenced by temperature in the forward voltage Vf of the diode 102. The voltage value which is inputted to the input terminal 109 is converted to temperature by the central processing unit 106.

Figure 6:
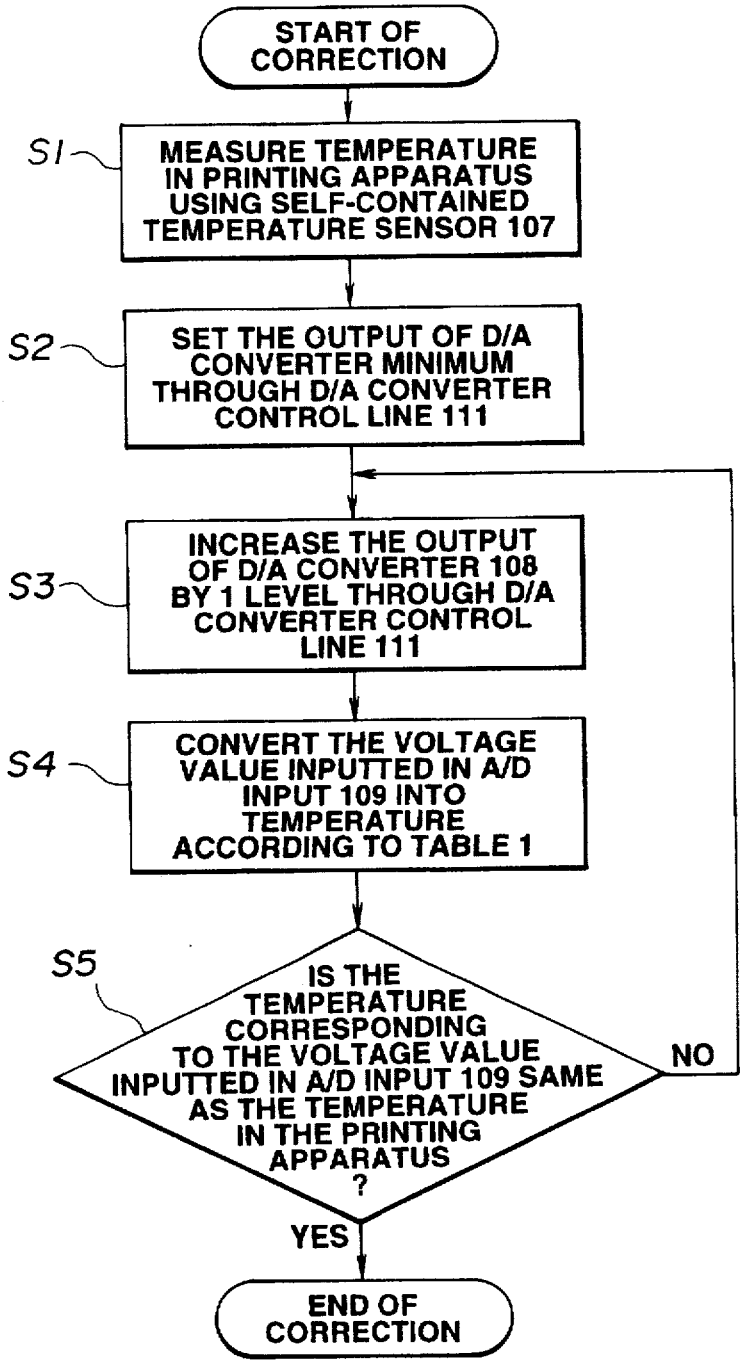
FIG. 6 is a flow chart for explaining the operation of the first embodiment of the present invention.

A concrete method performed by the circuit shown in FIG. 1, to correct the scatter in the forward voltage Vf of the diode 102 and to convert the voltage value inputted in the input terminal 109 for A/D conversion to the temperature of the IJ head, will be described hereinafter referring to FIG. 6 and Table 1.

TABLE 1

| T | V | A/D | T | V | A/D | T | V | A/D | T | V | A/D |
|---|---|---|---|---|---|---|---|---|---|---|---|
| −30.78° C. | 5.000 V | FEH | −5.35° C. | 3.750 V | BEH | 20.90 | 2.500 V | 7EH | 47.17° C. | 1.250 V | 3EH |
| −29.96 | 4.961 | FC | −4.53 | 3.411 | BC | 21.72 | 2.461 | 7C | 47.97 | 1.211 | 3C |
| −29.14 | 4.922 | FA | −3.71 | 3.672 | BA | 22.54 | 2.422 | 7A | 48.79 | 1.172 | 3A |
| −28.32 | 4.883 | F8 | −2.89 | 3.633 | B8 | 23.36 | 2.383 | 78 | 49.61 | 1.133 | 38 |
| −27.50 | 4.844 | F8 | −1.07 | 3.594 | B6 | 24.18 | 2.344 | 76 | 50.43 | 1.094 | 36 |
| −26.68 | 4.805 | F4 | −1.25 | 3.555 | B4 | 25.00 | 2.305 | 74 | 51.25 | 1.055 | 34 |
| −25.86 | 4.766 | F2 | −0.43 | 3.516 | B2 | 25.82 | 2.266 | 72 | 52.07 | 1.016 | 32 |
| −25.04 | 4.727 | F0 | 0.39 | 3.477 | B0 | 26.64 | 2.227 | 70 | 52.89 | 0.977 | 30 |
| −24.22 | 4.688 | EE | 1.21 | 3.438 | AE | 27.46 | 2.188 | 6E | 53.71 | 0.938 | 2E |
| −23.40 | 4.648 | EC | 2.03 | 3.398 | AC | 28.28 | 2.148 | 6C | 54.53 | 0.898 | 2C |
| −22.58 | 4.609 | EA | 2.85 | 3.359 | AA | 29.10 | 2.109 | 6A | 55.35 | 0.859 | 2A |
| −22.58 | 4.570 | E8 | 3.67 | 3.320 | A8 | 29.92 | 2.070 | 68 | 56.17 | 0.820 | 28 |
| −21.76 | 4.531 | E6 | 4.49 | 3.281 | A6 | 30.74 | 2.031 | 66 | 56.99 | 0.781 | 26 |
| −20.94 | 4.492 | E4 | 5.31 | 3.242 | A4 | 31.56 | 1.992 | 64 | 57.81 | 0.742 | 24 |
| −20.12 | 4.453 | E2 | 6.13 | 3.203 | A2 | 32.38 | 1.953 | 62 | 58.63 | 0.703 | 22 |
| −19.30 | 4.414 | E0 | 6.95 | 3.164 | A0 | 33.20 | 1.914 | 60 | 59.45 | 0.664 | 20 |
| −18.48 | 4.375 | DE | 7.77 | 3.125 | 9E | 34.02 | 1.875 | 5E | 60.27 | 0.625 | 1E |
| −17.66 | 4.336 | DC | 8.59 | 3.086 | 9C | 34.84 | 1.836 | 5C | 61.09 | 0.586 | 1C |
| −16.84 | 4.297 | DA | 9.41 | 3.047 | 9A | 35.66 | 1.797 | 5A | 61.91 | 0.547 | 1A |
| −16.02 | 4.258 | D8 | 10.23 | 3.008 | 98 | 36.48 | 1.758 | 58 | 62.73 | 0.508 | 18 |
| −15.20 | 4.219 | D6 | 11.05 | 2.969 | 96 | 37.30 | 1.719 | 56 | 63.55 | 0.469 | 16 |
| −14.38 | 4.180 | D4 | 11.88 | 2.930 | 94 | 38.13 | 1.680 | 54 | 64.38 | 0.430 | 14 |
| −13.55 | 4.141 | D2 | 12.70 | 2.891 | 92 | 38.95 | 1.641 | 52 | 65.20 | 0.391 | 12 |
| −12.73 | 4.102 | D0 | 13.52 | 2.852 | 90 | 39.77 | 1.602 | 50 | 66.02 | 0.352 | 10 |
| −11.91 | 4.063 | CE | 14.34 | 2.813 | 8E | 40.59 | 1.563 | 4E | 66.84 | 0.313 | 0E |
| −11.09 | 4.023 | CC | 15.15 | 2.773 | 8C | 41.41 | 1.523 | 4C | 67.66 | 0.273 | 0C |
| −10.27 | 3.984 | CA | 15.98 | 2.734 | 8A | 42.23 | 1.484 | 4A | 68.48 | 0.234 | 0A |
| −9.45 | 3.945 | C8 | 16.80 | 2.695 | 88 | 43.05 | 1.445 | 48 | 69.30 | 0.195 | 08 |
| −8.63 | 3.906 | C6 | 17.62 | 2.656 | 86 | 43.87 | 1.406 | 46 | 70.12 | 0.156 | 06 |
| −7.81 | 3.867 | C4 | 18.44 | 2.617 | 84 | 44.69 | 1.367 | 44 | 70.93 | 0.117 | 04 |
| −6.99 | 3.828 | C2 | 19.26 | 2.578 | 82 | 45.51 | 1.328 | 42 | 71.76 | 0.078 | 02 |
| −6.17 | 3.789 | C0 | 20.08 | 2.539 | 80 | 46.33 | 1.289 | 40 | 72.58 | 0.039 | 00 |

T: temperature of print head
V: A/D voltage
A/D: A/D value

First, correction steps carried out by the central processing unit 106, for correcting the scatter in the forward voltage Vf of the diode 102 will be described referring to the flow-chart shown if FIG. 6.

When the unshown power switch of the printing apparatus is turned on, the central processing unit 106 carries out the step to measure temperature of the atmosphere within the printing apparatus using the self-contained temperature sensor 107 (step S1).

Next, the output of the D/A converter 108 is set to be minimum through the control line 111 (step S2).

In step S3, the central processing unit 106 increases the output value of the D/A converter 108 by one, and converts the value of the voltage inputted to the input terminal 109 for A/D conversion to the digital value, then converts it to temperature of the head according to Table 1 (step S4).

Next, the central processing unit 106 compares the converted temperature of the head with the previously measured temperature of atmosphere in the printing apparatus, and if they are same, the correction operation is finished (in step S5, yes). If they are not the same (in step S5, no), the central processing unit 106 increases the output value of the D/A converter 108 by one again (step S3). These steps are repeatedly carried out and when the converted temperature of the head is the same as the previously measured temperature of atmosphere in the printing apparatus, the central processing unit 106 stops the correction operation.

Namely, the voltage value outputted from the D/A converter 108 when the temperature of the head is the same as the temperature of atmosphere in the printing apparatus, is considered to be the correction value for correcting the forward voltage Vf of the diode 102.

Therefore, after the correction operation is completed, by converting the voltage value inputted to the input terminal 109 for A/D conversion to temperature according to Table 1, the temperature of the IJ head 101 can be precisely measured.

The central processing unit 106 controls the ink discharge energy and controls the size of ink droplets in accordance with thus precisely measured temperature of the IJ head, and therefore fine printing can be performed.

Simultaneously with the completion of the correction operation, subtracting the area which is not influenced by temperature in the forward voltage Vf of the diode 102 is completed, and the expansion of dynamic range of the area which is influenced by temperature in the forward voltage Vf of the diode 102 is also completed.

Figure 7:
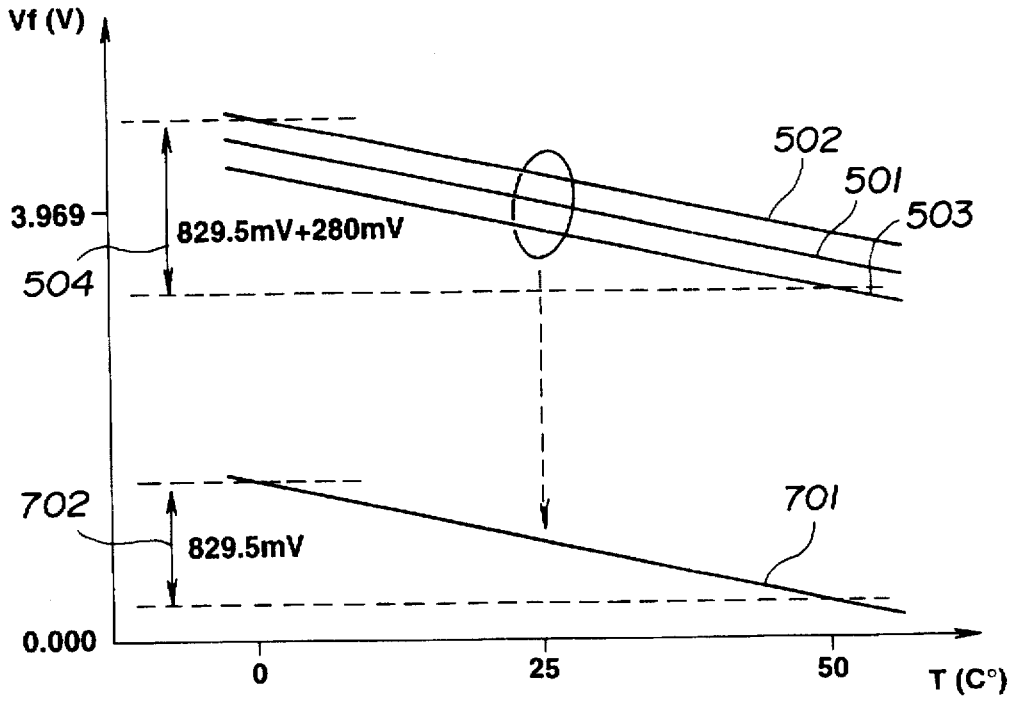
FIG. 7 is a graph showing the characteristic of the forward voltage and the temperature of a diode.

Next, subtracting the area which is not influenced by temperature change in the forward voltage Vf of the diode 102 will be described with reference to FIG. 7.

Figure 5:
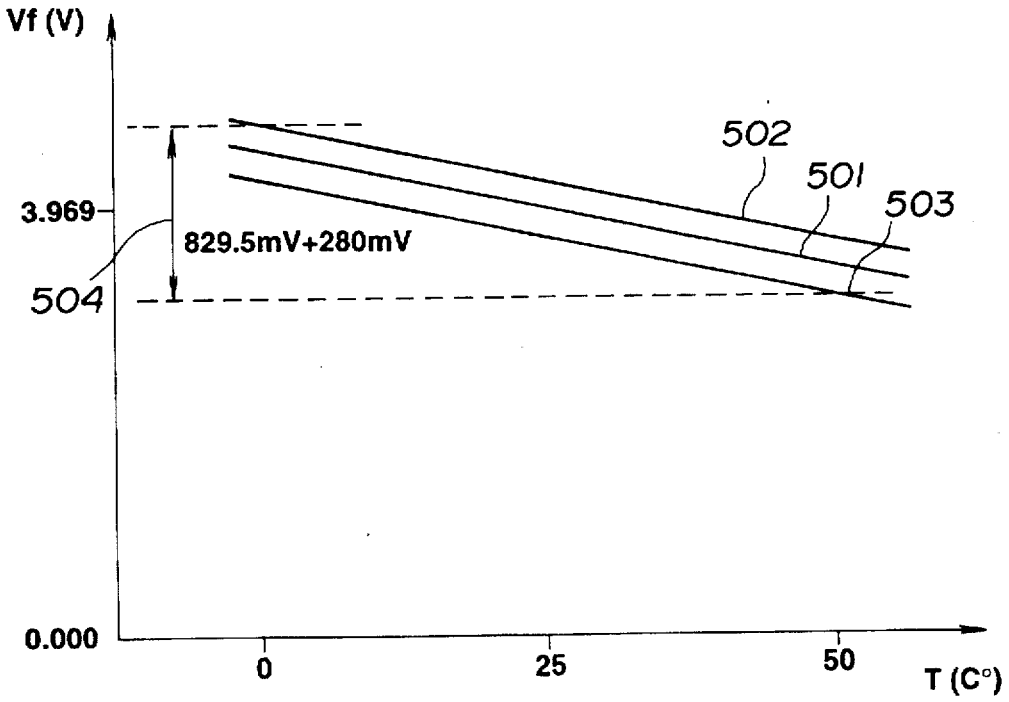
FIG. 5 is a graph showing the characteristic of the forward voltage and the temperature of a diode.

Reference numerals 501, 502 and 503 denote characteristic curves similar to those explained referring to FIG. 5.

The areas which are to be measured in those characteristic curves 501, 502 and 503, are inclined portions, and other portions including the scatter of the forward voltage Vf in those curves are areas which are not influenced by temperature, and are not necessary when measuring temperature.

Accordingly, the fixed value corresponding to this area must be subtracted. Reference numeral 701 in FIG. 7 denotes a characteristic curve in which the fixed value is taken off, and reference numeral 702 denotes a variable amount between 0° C. to 50° C.

The second amplifier 105 in FIG. 1 carries out the taking off operation, and the taking off fixed value corresponds to the voltage value outputted from the D/A converter 108.

Figure 8:
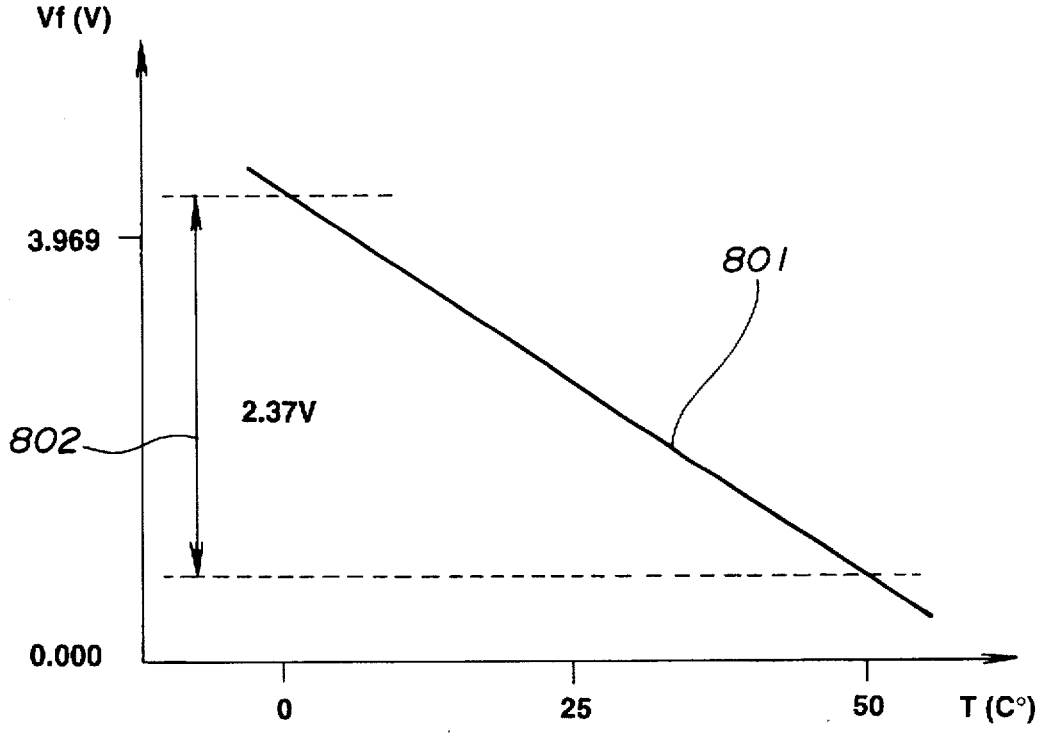
FIG. 8 is a graph showing the characteristic of the forward voltage and the temperature of a diode.

FIG. 8 is a drawing for explaining the expansion of dynamic range of the area which is influenced by temperature variation in the forward voltage Vf of the diode 102.

In FIG. 8, a characteristic curve 801 denotes the voltage in which the characteristic curve 701 is amplified by the second amplifier 105 in FIG. 1. In addition, reference numeral 802 denotes a variable amount between 0° C. to 50° C. The above described Table 1 is a rewriting version of the characteristic curve 801.

Figure 9:
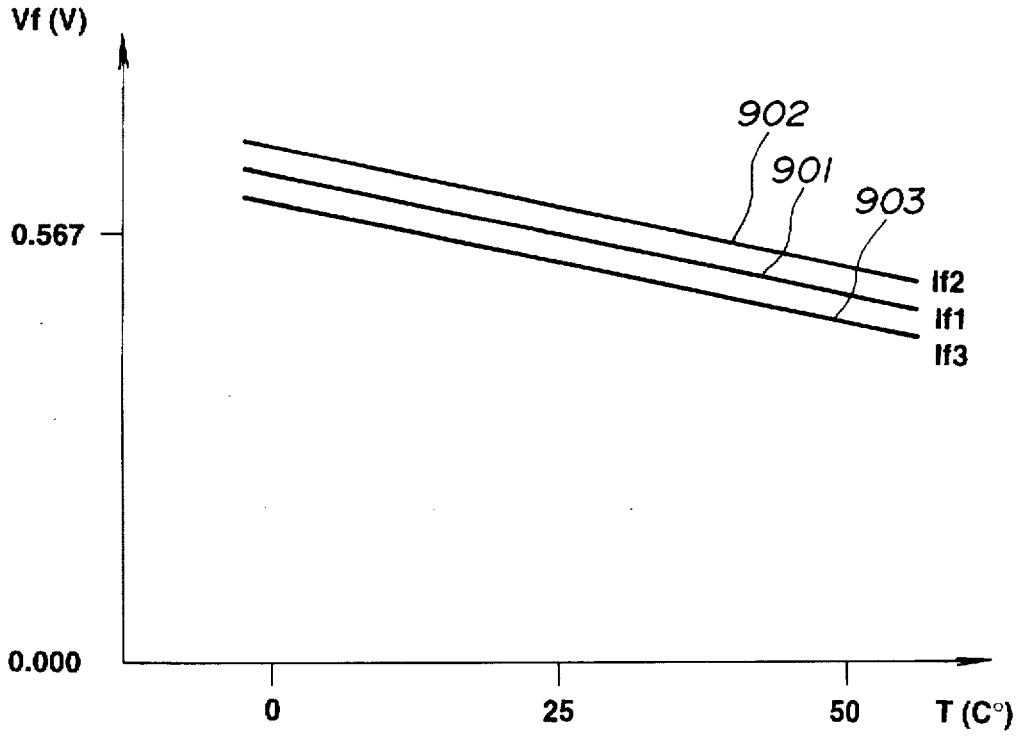
FIG. 9 is a graph showing the characteristic of the forward voltage and the temperature of a diode.
Figure 10:
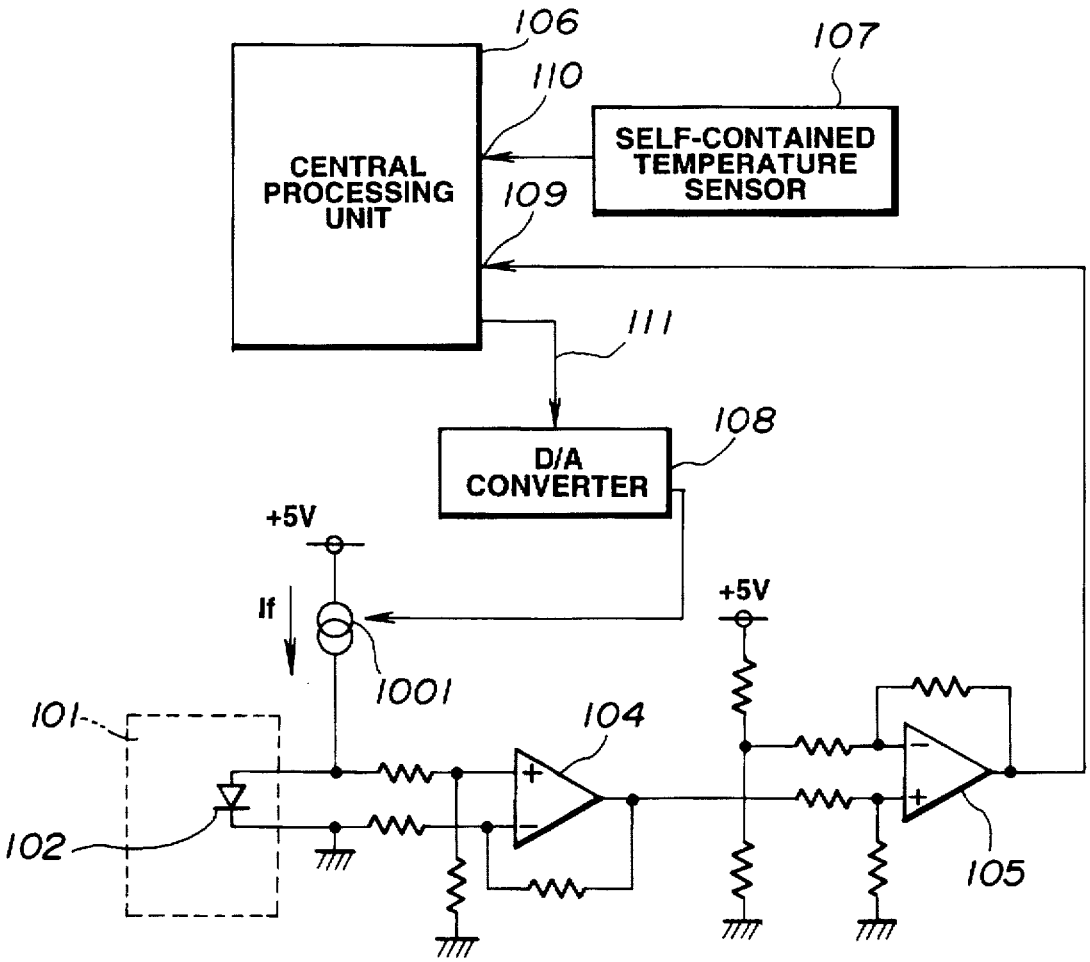
FIG. 10 is a schematic block diagram for explaining a second embodiment of the present invention.

FIGS. 9 and 10 are views for explaining the second embodiment of the present invention.

FIG. 9 shows a characteristic curve in which the forward current value of the diode as a temperature measuring means is changed, and the horizontal axis denotes an ambient temperature T(° C.) and the vertical axis denotes a forward voltage Vf (V) of the diode when the constant forward current is applied to the diode.

Reference numeral 901 in FIG. 9 denotes a characteristic curve of the relation between the forward voltage and the ambient temperature in which the forward constant current of 200 μA is applied to the diode 102 which has a standard characteristic for measuring temperature. It will be understood for FIG. 9 that the forward voltage Vf drops as the temperature rises, and that the forward voltage Vf of the diode is 0.567 V at 25° C.

Reference numeral 902 in FIG. 9 denotes a characteristic curve of the relation between the forward voltage and the ambient temperature when the forward constant current of 400 μA is applied to the above mentioned diode. Similarly, reference numeral 903 denotes a characteristic curve of a relation between the forward voltage and the ambient temperature when the forward constant current of 100 μA is applied to the diode.

According to FIG. 9, it will be understood that the absolute value of the forward voltage Vf of the diode changes greatly in accordance with the value of the forward current, however the characteristic of voltage variation in accordance with the variation of temperature scarcely changes.

FIG. 10 is a schematic block diagram for explaining the second embodiment of the present invention. In this second embodiment, the scatter of the diode is corrected utilizing the characteristic curves shown in FIG. 9.

In FIG. 10, the portions having the same functions as the portions shown in FIG. 1 have the same reference numerals.

Reference numeral 1001 denotes a constant current circuit in which a suitable current value can be set through the D/A converter 108.

The operation according to the second embodiment will be described hereinafter.

When the unshown power switch of the printing apparatus is turned on with the IJ head 101 mounted in the body of the printing apparatus, a constant current If of 200 μA is supplied to the diode 102 from the constant current circuit 1001. The forward voltage Vf of the diode 102 is amplified seven times by the first amplifier 104, and is inputted to the non-reverse input terminal of the second amplifier 105.

In this condition, a voltage corresponding to the correction data for a standard diode is inputted to the reverse input terminal of the second amplifier 105, and a voltage value in which the voltage corresponding to the correction date is subtracted from the output value of the amplifier 104 (that is, the value in which the area in the forward voltage Vf of the diode 102 which is not influenced by the variation of temperature is subtracted), is amplified by 2.86 times by the amplifier 105 and is inputted to the input terminal 109 for A/D conversion of the central processing unit 106. The amplified voltage value is generated by expanding the dynamic range of the area which is influenced by the variation of the forward voltage Vf of the diode 102.

The amplified voltage value is converted to the temperature of the IJ head by the central processing unit 106.

Figure 11:
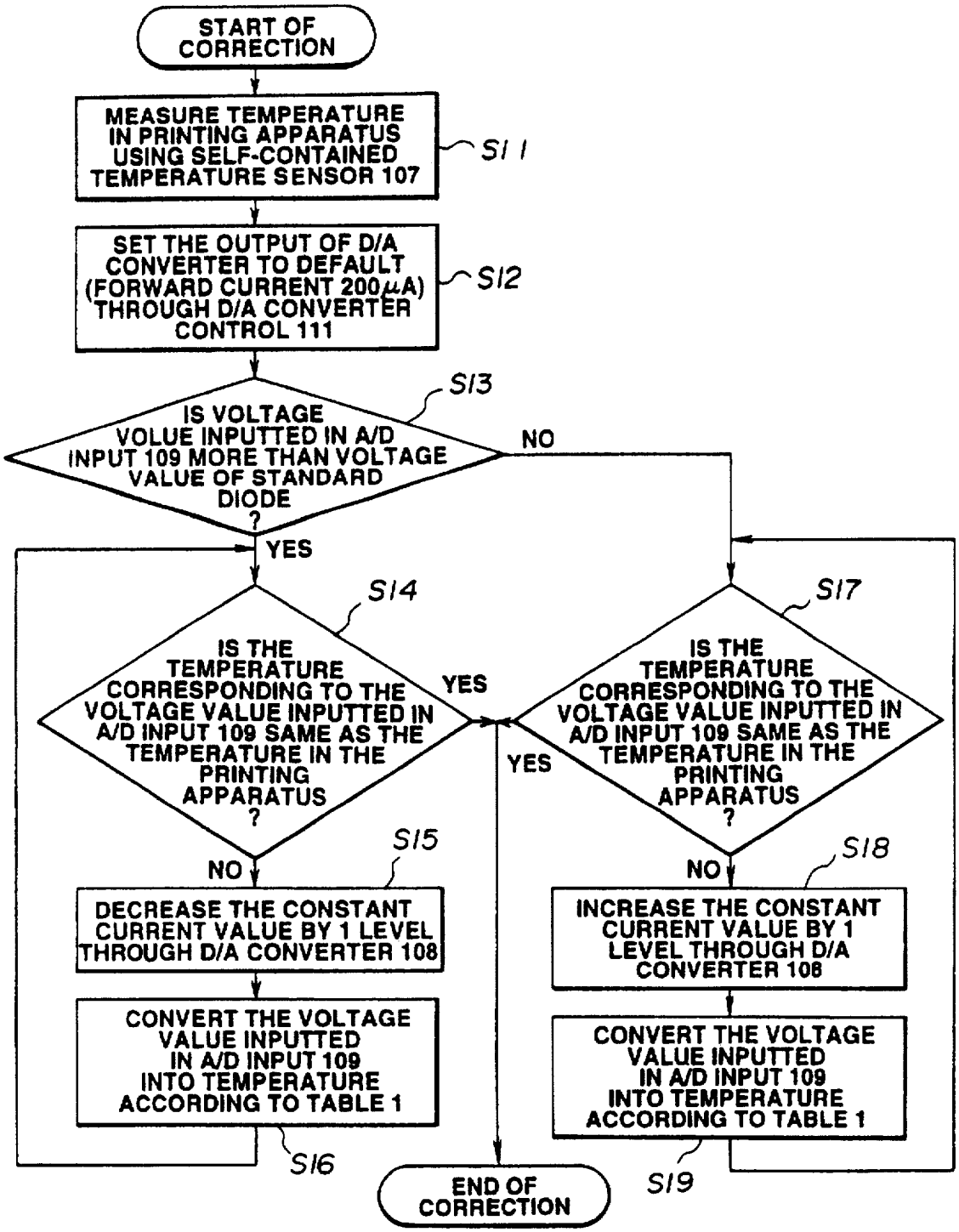
FIG. 11 is a flow chart for explaining the operation of the second embodiment of the present invention.

Next, a concrete correcting method carried out by the circuit shown in FIG. 10 (the second embodiment) for correcting the scatter of the forward voltage Vf of the diode 102, and a concrete method for converting the voltage value inputted in the input terminal 109 for A/D conversion to the temperature of the IJ head, will be described referring to FIG. 11 and Table 1.

First, a correcting method for correcting the scatter of the voltage VF of the diode 102 will be described referring to the flow-chart shown in FIG. 11.

When the power switch of the printing apparatus which is not shown in FIG. 10 is turned on, the central processing unit 106 instructs the self-contained temperature sensor 107 to measure ambient temperature in the printing apparatus (step S11).

Next, the output of the D/A converter 108 is set as the default value through the control line 11 such that the forward current of the diode 102 is 200 μA (step S12).

Next, the voltage value inputted in the input terminal 109 for A/D conversion is converted to the digital value, and the digital value is compared with the voltage value of a standard diode (step S13).

Regardless of the comparison with the standard diode, if the converted head temperature is the same as the ambient temperature in the printing apparatus, the correction operation is completed (steps S14, S17).

If, however, the converted head temperature is different from the ambient temperature and the value measured by the diode 102 is large (in step S13, yes), the central processing unit 106 decreases the output of the D/A converter 108 by 1 level (step S15), that is, the forward current value is decreased.

On the other hand, if the converted head temperature is different from the atmosphere temperature and the value measured by the diode 102 is small (in step S13, no), the central processing unit 106 increases the output of the D/A converter 108 by 1 level (step S18), that is, the forward current value is increased.

After that, the current value of the input terminal 109 for A/D conversion is converted to a digital value, and moreover it is converted to temperature according to Table 1 (step S16, S19).

The converted temperature is compared with the previously measured ambient temperature in the printing apparatus. If they are the same, the correction operation is completed, but if they are not the same, the output of the D/A converter 108 is increased again by one level, or is decreased by one level, and these steps are repeatedly carried out. As a result, when they become the same value, the correction operation is completed. That is, when the converted temperature and the atmosphere temperature become the same, the voltage value outputted from the D/A convertor 108 corresponds to the correction value for correcting the scatter in the forward voltage Vf of the diode 102.

Accordingly, after the correction operation is completed, temperature of the head 101 can be measured by converting the voltage inputted in the input terminal 109 for A/D conversion into temperature according to Table 1.

The correction operation is thus completed like the first embodiment and at the same time, subtracting the area in the forward voltage Vf of the diode which is not influenced by the variation of temperature is completed and the expansion of the dynamic range of the area in the forward voltage Vf of the diode 102 which is influenced by the variation of temperature is also completed.

Figure 12:
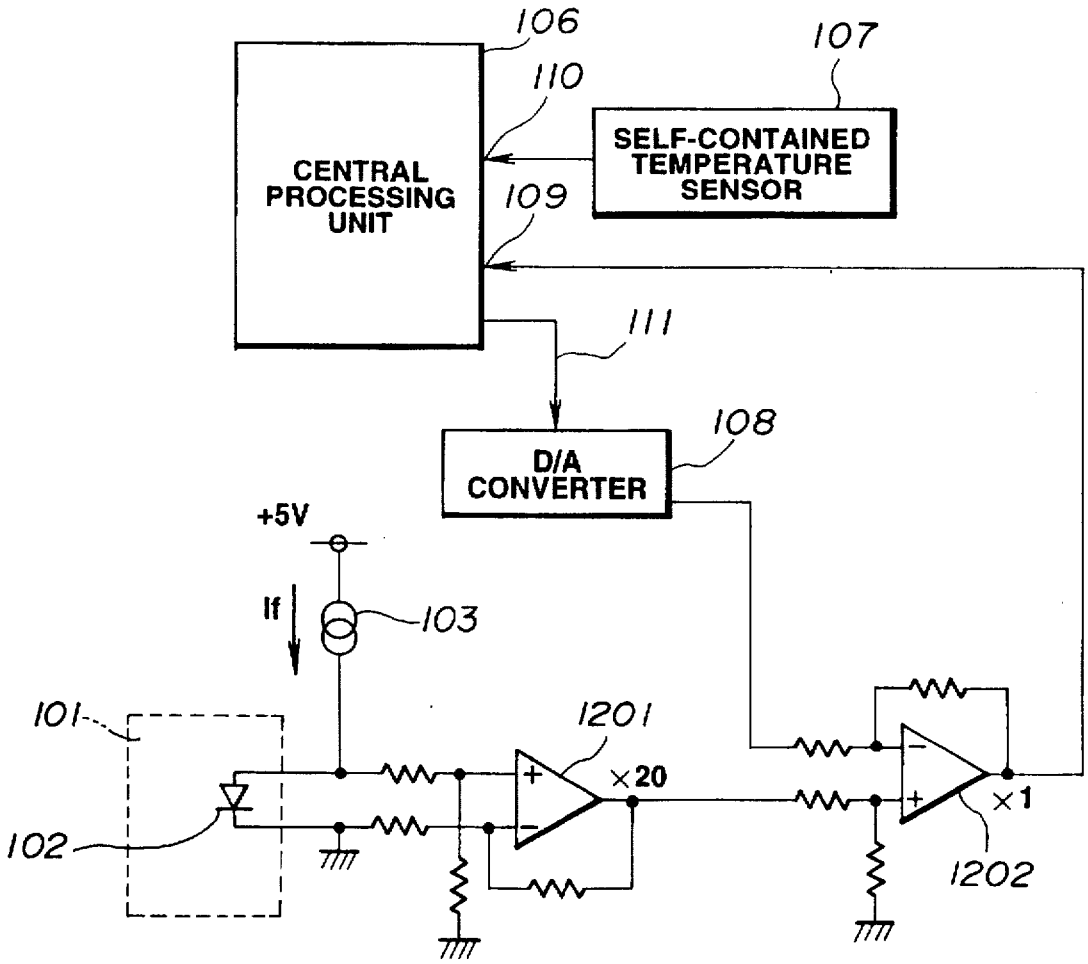
FIG. 12 is a schematic block diagram for explaining a third embodiment of the present invention.

FIG. 12 shows a schematic block diagram for explaining the third embodiment of the present invention.

In the above-described the first and second embodiments, the gain of the first amplifier 104 is seven times and the gain of the second amplifier 105 is 2.86 times. However, in the third embodiment, the gain of the first amplifier 1201 is twenty times and the gain of the second amplifier 1202 is one time. These settings of the gain in the third embodiment are also applicable in the first and second embodiments. In such a construction, a power source of high voltage is generally used.

The characteristic of the diode and the gain of the amplifier are not limited to those described in the foregoing and they can be suitably selected and applied in accordance with, for example, the temperature measuring area, measurement degree of precision and the voltage of the power source to be used in the circuit.

Figure 13:
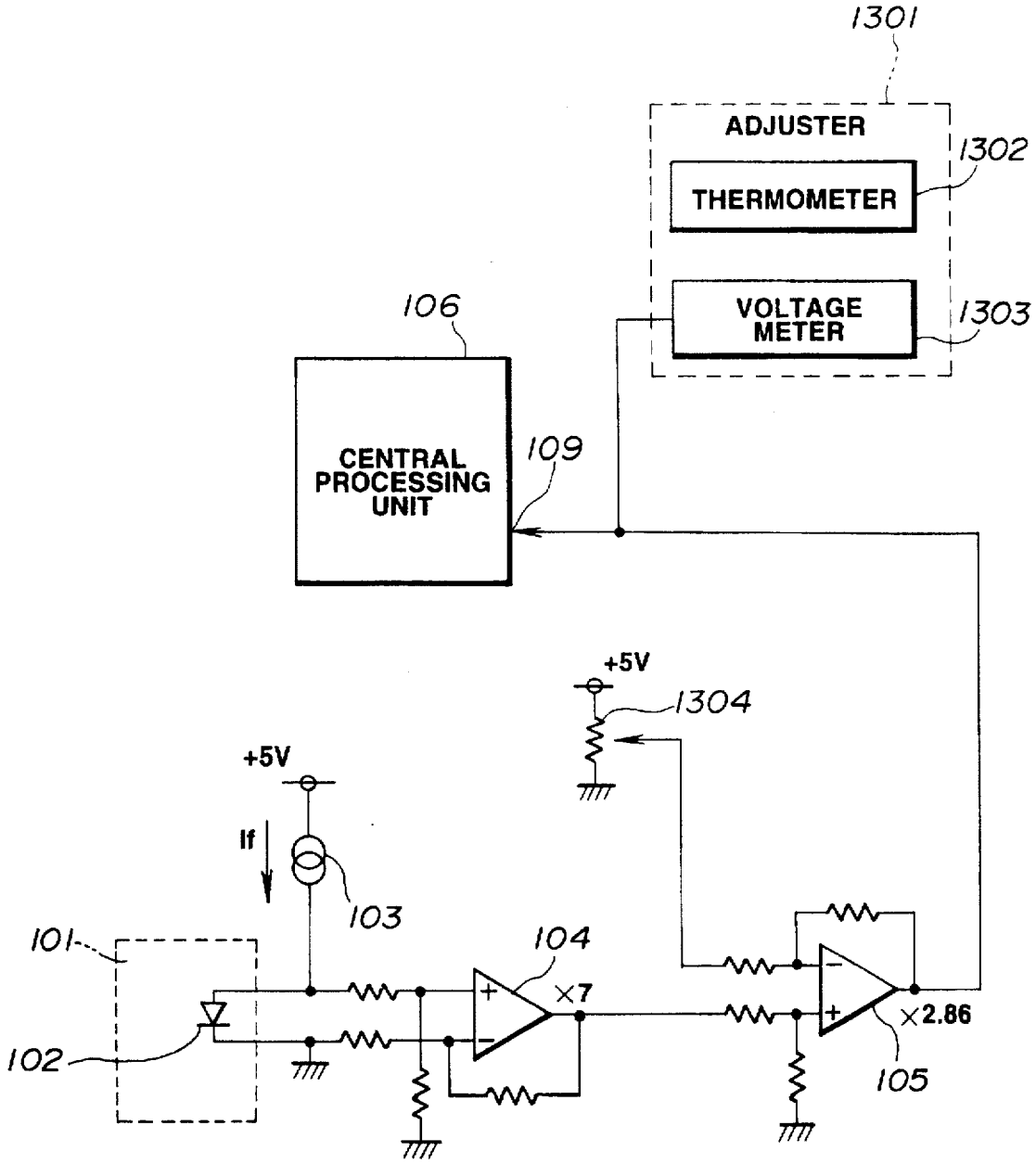
FIG. 13 is a schematic block diagram for explaining a fourth embodiment of the present invention.

FIG. 13 shows a schematic block diagram for explaining the fourth embodiment of the present invention.

In the first and second embodiments, the correction of the characteristic of the diode is performed automatically using the D/A converter 108, however, by measuring temperature manually using the instrument for adjustment 1301 such as the thermometer 1302 and by measuring voltage manually using the voltage meter 1303, the D/A converter 108 can be substituted with a variable resistor 1304 and the adjustment can be manually performed in the production process of the printing apparatus.

In addition, the manner of adjusting in the fourth embodiment can be also applicable to the above described first, second and third embodiments.

Figure 14:
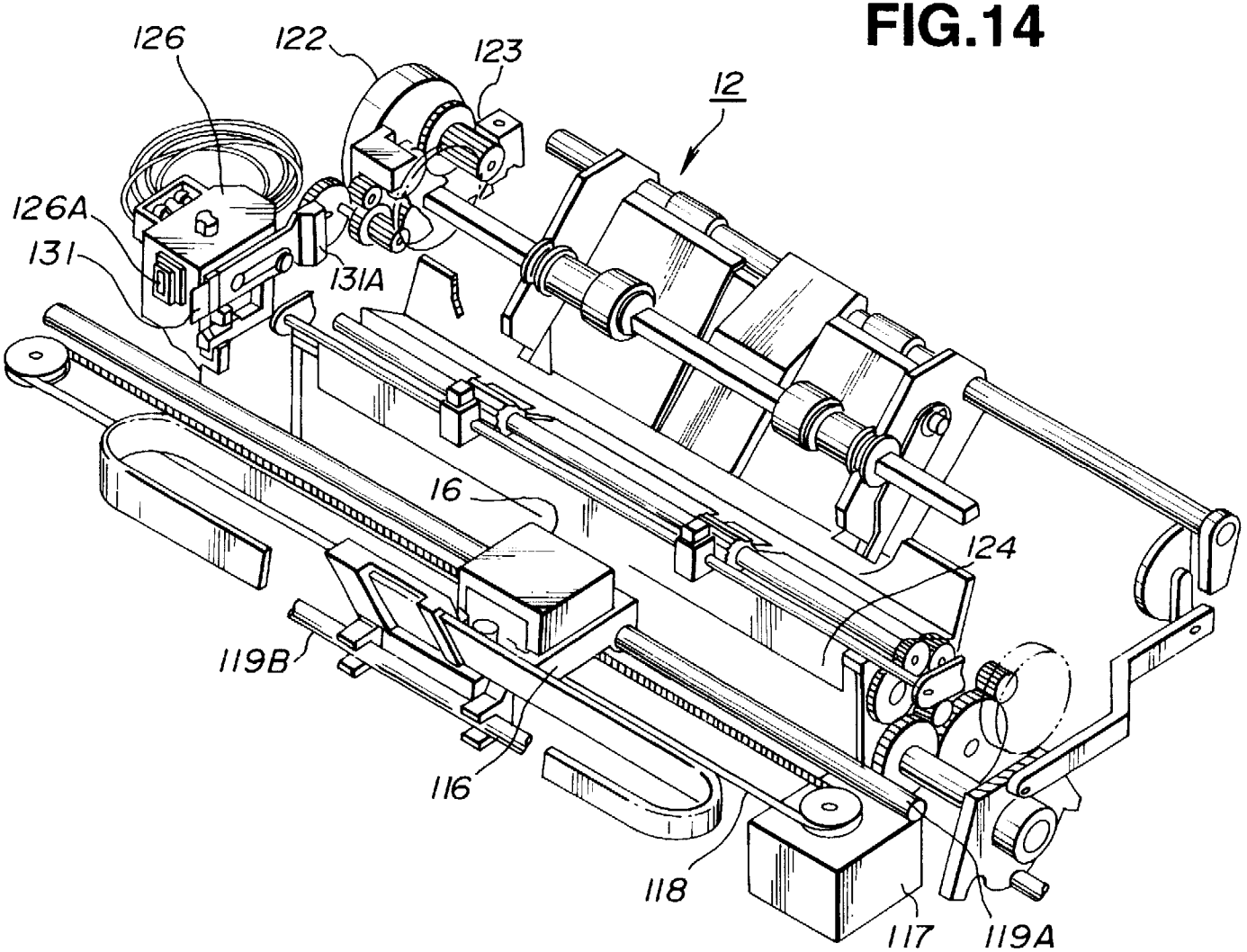
FIG. 14 is a schematic perspective view showing an ink jet printing apparatus of the present invention.
Figure 15:
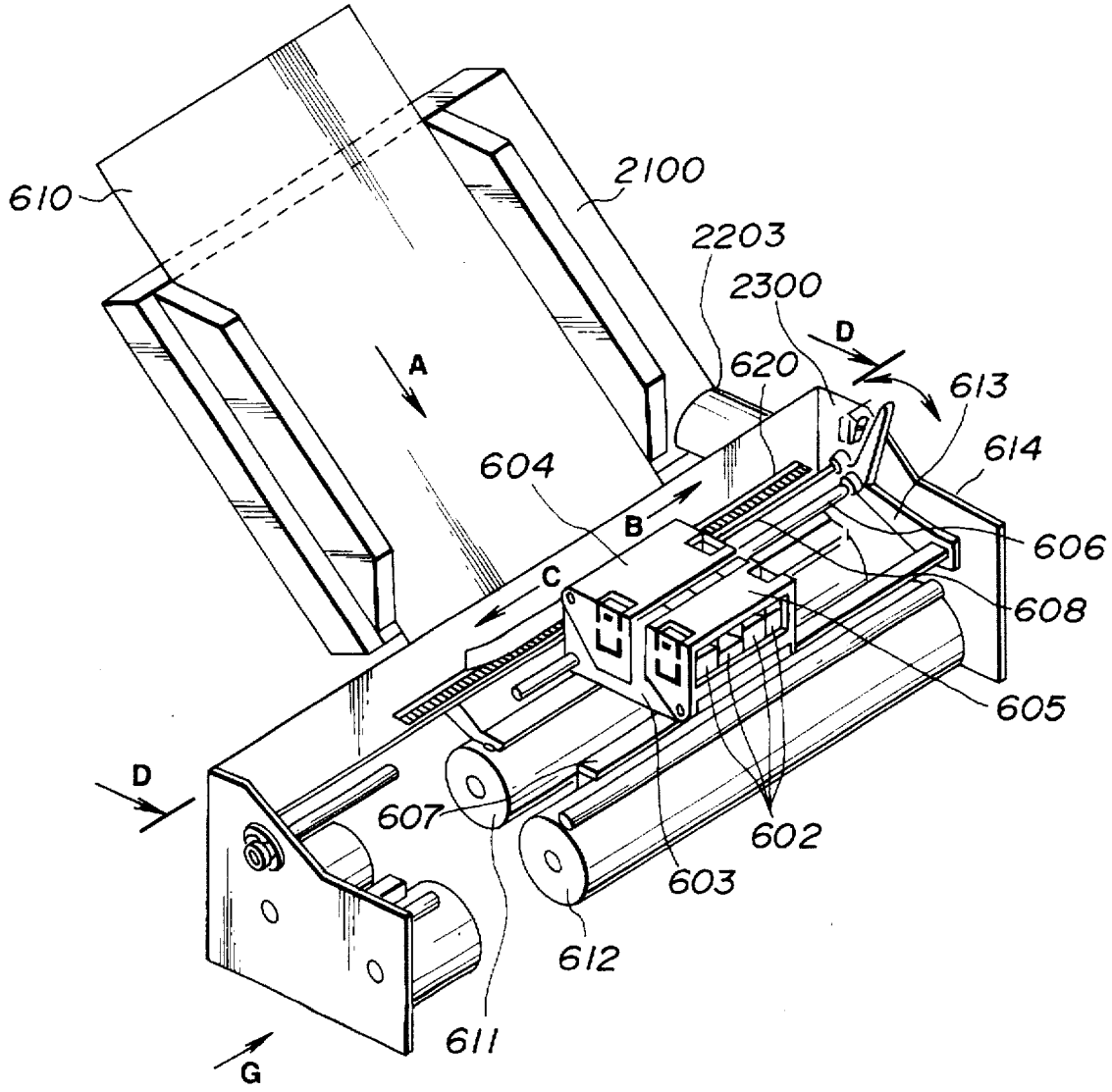
FIG.15 PRIOR ART
FIG. 15 is a schematic perspective view of a conventional ink jet printing apparatus.

FIG. 14 is a schematic perspective view of the main portion 12 of the ink jet printing apparatus to which the present invention is applicable. In FIG. 14, reference numeral 16 denotes an ink jet head (print head) having nozzles for discharging ink onto the printing medium which is conveyed on the platen 124. Reference numeral 116 denotes a carriage for supporting the print head 16, and the carriage is connected with a portion of the drive belt 118 for transmitting the drive force from a drive motor 117 and is slidable on the parallelly provided two guide shafts 119A and 119B, whereby it is possible for the print head 10 to move forwardly and reversely between both sides of the printing medium.

During this forward and return movement of the print head 16, the print head prints an image on the printing medium in accordance with print data. After each scanning of the carriage 116, the printing medium is conveyed by a predetermined amount in a direction perpendicular to the scanning direction of the carriage 116.

Reference numeral 126 denotes a ink discharge recovery unit, and is provided at one end of the moving path of the print head 16, for example, at the position where the recovery unit 126 faces a home position of the print head 16.

The recovery unit 126 is driven by a motor 122 through a transmitting mechanism 123 for capping of the print head 16.

An ink discharge recovery operation such as an operation of removing the ink having high viscosity is performed by discharging ink forcibly from ink discharge ports of the print head using a suitable suction means provided in the recovery unit 126, such as a suction pump for sucking ink from the ink discharge ports while cap 126A of the recovery unit 126 is capping the print head 16.

In addition, after the printing operation is finished, the print head 10 is capped by the cap 126A and protected.

Such as ink discharge recovery operation is carried out, for example, when the power switch is turned on, when the print head 16 is exchanged, and after a predetermined time period of non-printing has passed.

Reference numeral 131 denotes a blade made of, for example, silicone rubber for wiping the surface of the print head 16, and is provided adjacent to the recovery unit 126. The blade 131 is supported by a blade support member 131A in the form of the cantilever, and is driven by the motor 122 through the transmitting mechanism 123 like the recovery unit 126, and is capable of contact with the discharge port surface of the print head 16.

The blade 131 is moved into the moving path of the print head 16, and wipes off the ink mist, ink droplets or dust from a discharge surface of the print head 16, at a suitable timing during the process of the printing operation, or after the ink discharge recovery operation performed by the recovery unit 126 has been completed.

In the above described first to fourth embodiments, the printing apparatus is described as an ink jet printing apparatus, however, the types of the printing apparatuses are not limited and any printer utilizing thermal energy such as a thermal transfer type printer and a thermal sensitive type printer are also applicable to the present invention.

In addition, in the above described embodiments, as the head temperature measuring means, a diode is used, however, a device such as a thermistor whose characteristic varies when temperature changes can be used.

Next, another embodiment of the printing apparatus of the present invention will be described in detail with reference to the accompanying drawings.

Figure 17:
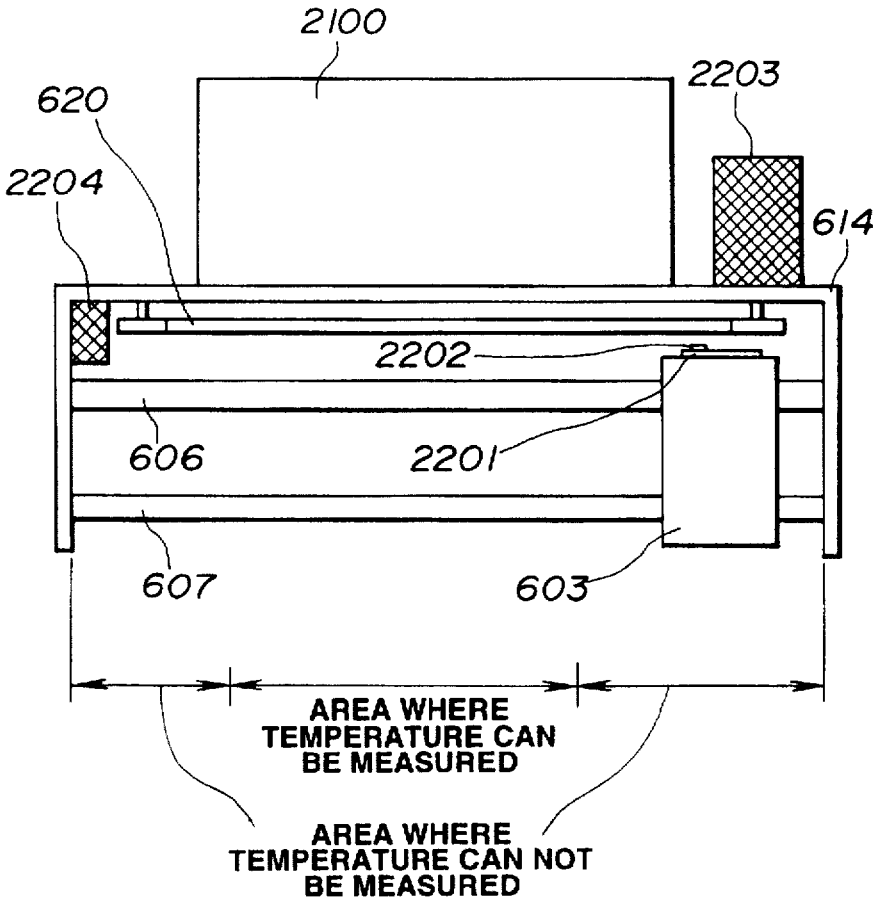
FIG. 17 is a schematic view for explaining a fifth embodiment of the present invention.

FIG. 17 is a schematic view for explaining the fifth embodiment of the present invention. In this embodiment, temperature is not measured near the places where the parts generating heat such as a carriage motor (CR motor) are provided, but is measured at the portion in the printing apparatus where the temperature scarcely changes.

According to the construction of the printing apparatus of this embodiment, since the temperature sensor 2202 is disposed on the carriage base plate 2201, when the carriage base plate 2201 is near the CR motor 2203 or the LF motor 2204, the ambient temperature measured by the temperature sensor 2202 varies because it is influenced by the heat from those parts. Therefore, in the present invention, the temperature is measured when the temperature sensor 2202 is in the place where the temperature sensor 2202 is scarcely influenced by the heat from those parts, for example, when the temperature sensor 2202 is in the middle portion of the printing apparatus. The best area to measure the temperature is the area where the variation amount of temperature is the lowest in FIG. 17.

Figure 16:
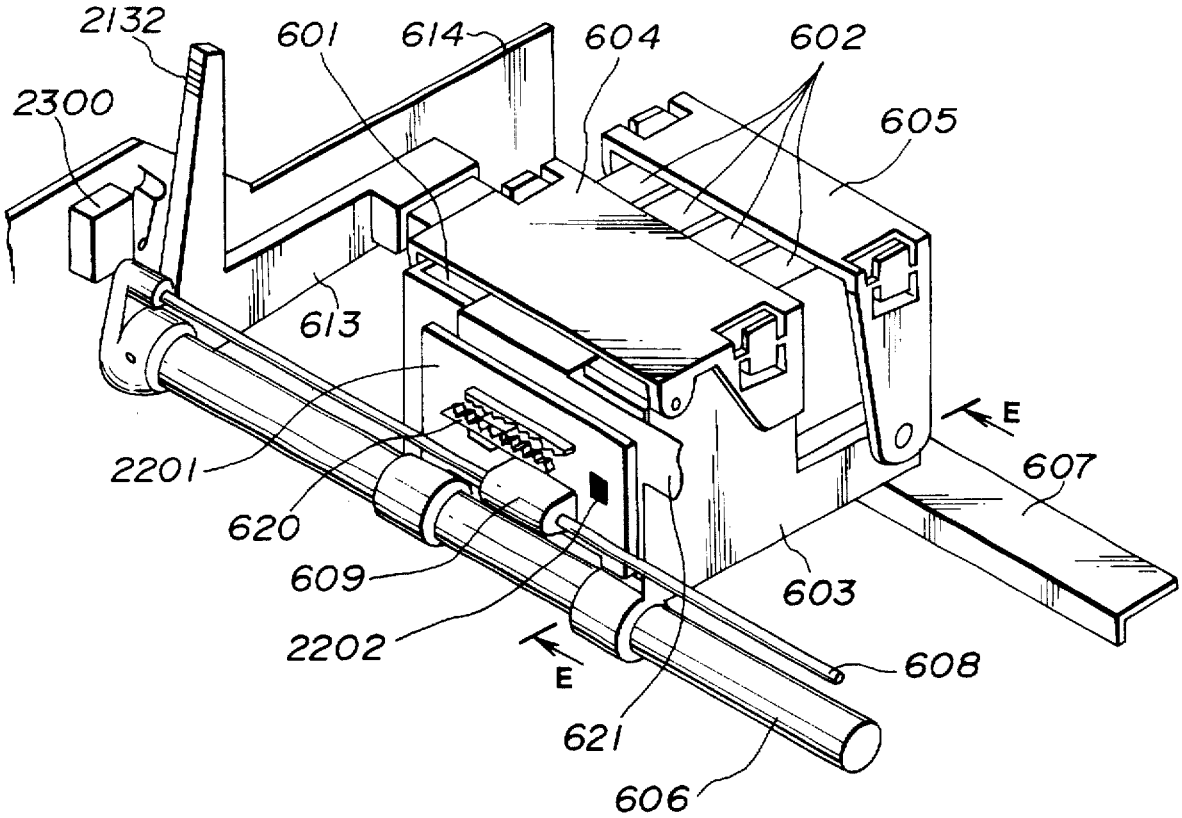
FIG.16 PRIOR ART
FIG. 16 is a schematic perspective view of a conventional carriage unit of the conventional ink jet printing apparatus.

On the other hand, a position of the carriage 603 can be detected on the basis of the signal outputted from the reading element 609 shown in FIG. 16.

Figure 18:
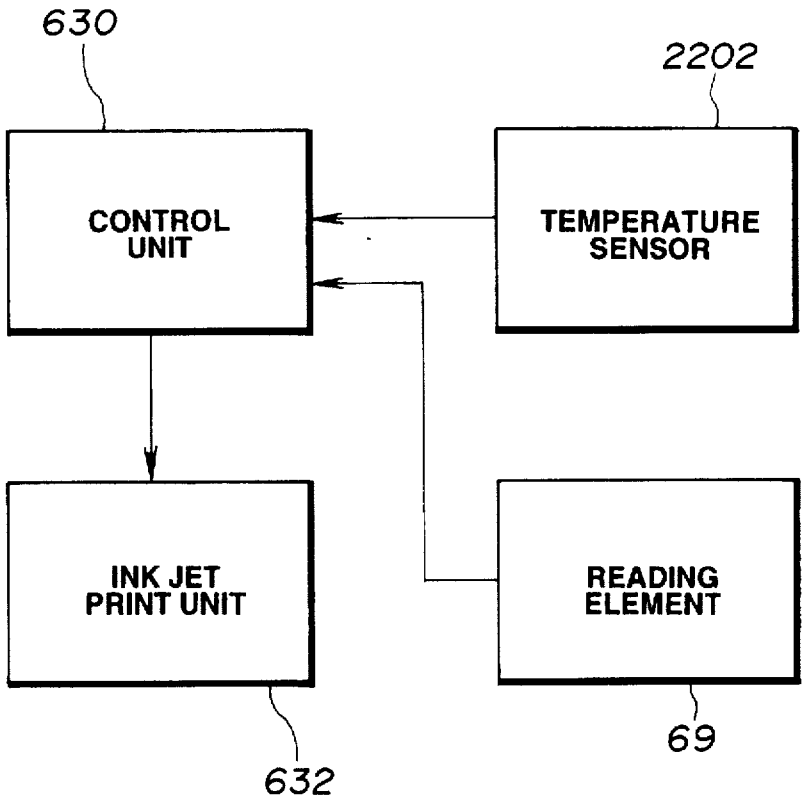
FIG. 18 is a schematic block diagram for explaining the printing apparatus of the present invention.

FIG. 18 shows a block diagram for explaining the fundamental constitution of the printing apparatus according to the present invention. In FIG. 18, a control unit 630 is constituted by such a CPU and ROM or the like, and the unit controls various operations of the printing apparatus.

The position of the carriage 603 is detected by the reading element 609 shown in FIG. 16 and the control unit 630 controls such that the temperature sensor 2202 measures temperature when the carriage 603 is within the middle area of the printing apparatus where influence of heat from electrical parts is minimal.

In accordance with the result of temperature measurements, the control unit 630 determines the drive condition of the ink jet print unit 632 constituted by the ink jet print head 601 shown in FIG. 16 and its driver, and controls the ink jet print unit 632 to perform the printing on the printing medium.

Figure 19:
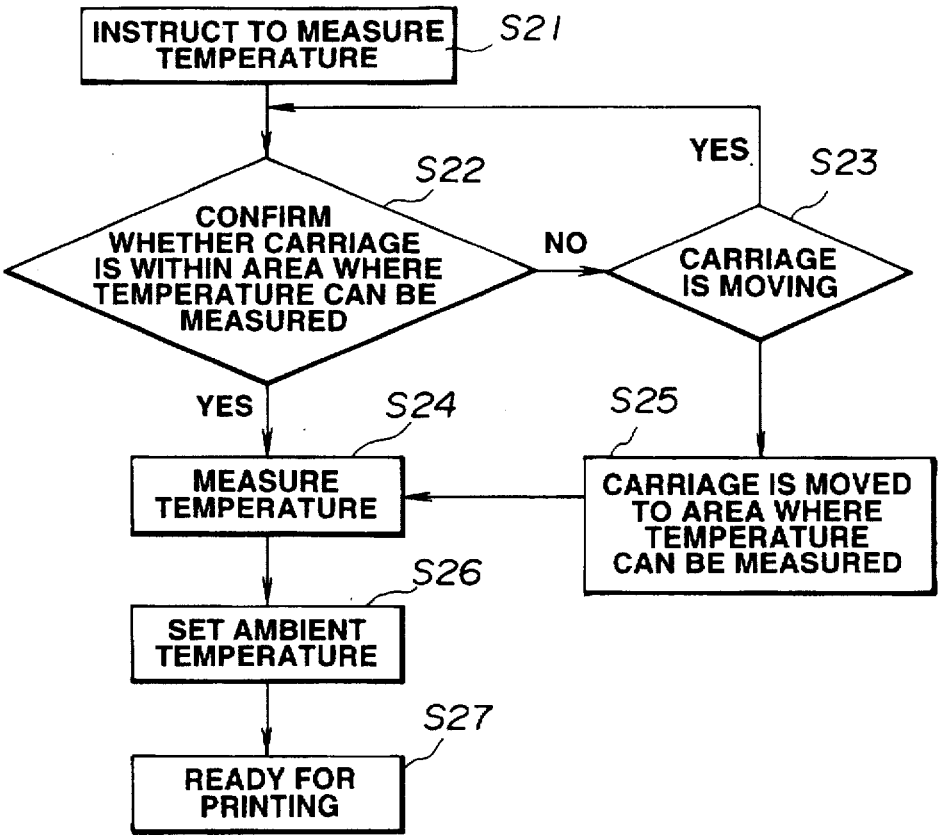
FIG. 19 is a flow chart for explaining the fifth embodiment of the present invention.

FIG. 19 shows a schematic flow-chart of temperature measurement carried out by control unit 630.

During the printing operation, when the temperature measurement is instructed (step S21), the position of the carriage 603 is detected by reading element 609 (step S22), and if the carriage 603 is within the temperature measurement area, the temperature sensor 2202 carries out the temperature measurement (step S24). If the carriage 603 is not within the temperature measurement area, the operation of the carriage is confirmed (step S23), and if the carriage 603 moves into the temperature measurement area, the temperature measurement by the sensor 2202 is carried out when the carriage 603 is in that area (step S24). If the carriage 603 is not operating, the carriage 603 is forcibly moved into the temperature measurement area (step S25) and the temperature measurement is carried out (step S24).

As described in the foregoing, the temperature measurement is carried out when the carriage 603 is in the area where the ambient temperature change is very low, and therefore the temperature can be precisely measured.

Next, the sixth embodiment of the present invention will be described hereinafter.

The constitution of this embodiment is similar to that of the fifth embodiment. In this sixth embodiment, temperature measurement is carried out periodically, and the position of the carriage 603 is detected by the reading element 609 shown in FIG. 16. The data of temperature which is measured only when the carriage 603 is in the temperature measurement area shown in FIG. 17, is selected and used for all the temperature data, whereby it is possible to get the precise temperature data.

Figure 20:
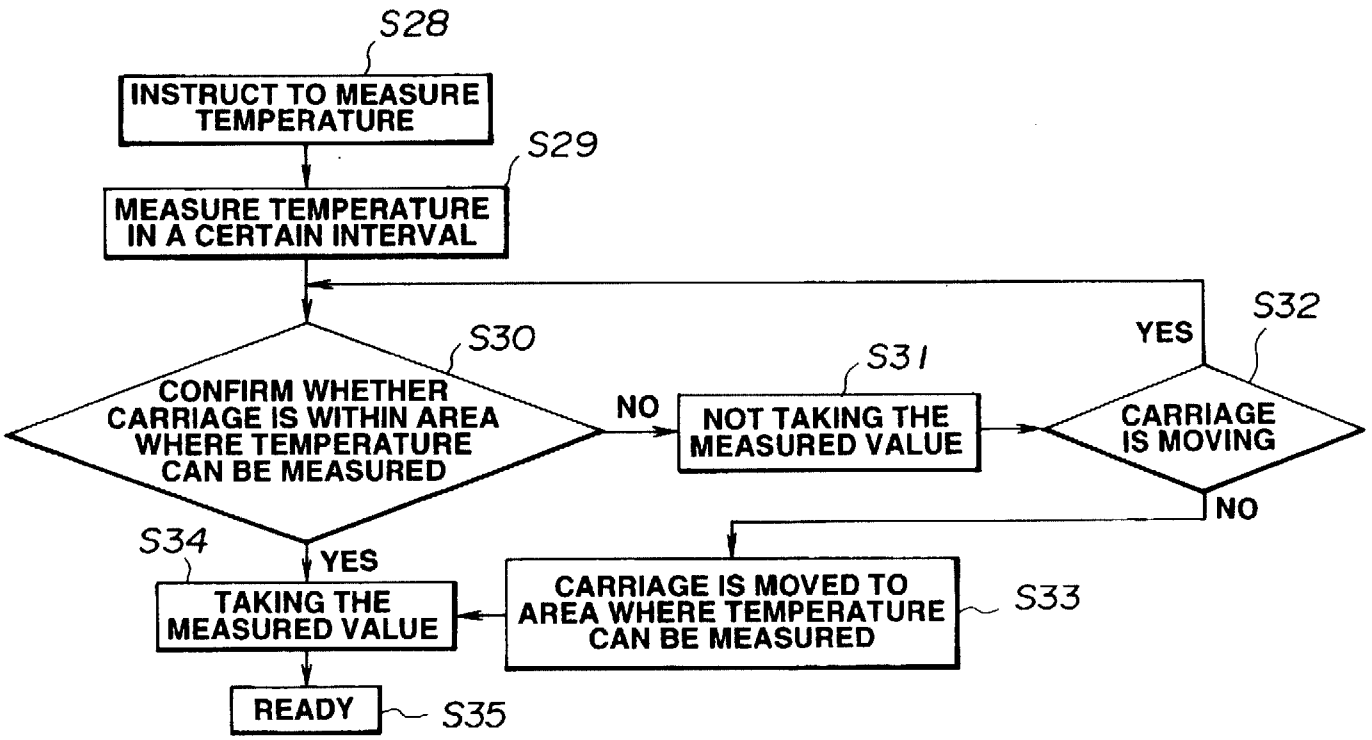
FIG. 20 is a flow chart for explaining a sixth embodiment of the present invention.

FIG. 20 shows a schematic flow-chart of the temperature measurement operation carried out by the control unit 630.

When the temperature measurement is instructed in step S28, the temperature measurement is carried out periodically in step S29. Then, the position of the carriage 603 is detected (step S30), and if the carriage 603 is in the temperature measurement area, the temperature data measured in step S34 is considered to be the ambient temperature (the temperature of ink), and the printing operation is controlled on the basis of the ambient temperature.

On the other hand, if the carriage 603 is not in the temperature measurement area (step S30), the measured data is not used for controlling the printing operation (step S31), and the operation of the carriage 603 is confirmed (step S32).

If the carriage 603 is moving, the operation goes back to step S30, and the operation advances to step S34 when the carriage 603 moves into the temperature measurement area. If the carriage is not moving (step S32), the carriage 603 is forcibly moved (step S33), and the temperature data is used to control the ink discharge in the printing operation only when the carriage is in the temperature measurement area (step S34).

Next, the seventh embodiment of the present invention will be described hereinafter. This embodiment has a constitution similar to that of the sixth embodiment.

In this embodiment, temperature measurement is carried out in the whole area where the carriage can move, and the condition of the temperature distribution is measured. The control for driving the ink jet head is carried out in accordance with the above described condition of the temperature distribution.

Figure 21:
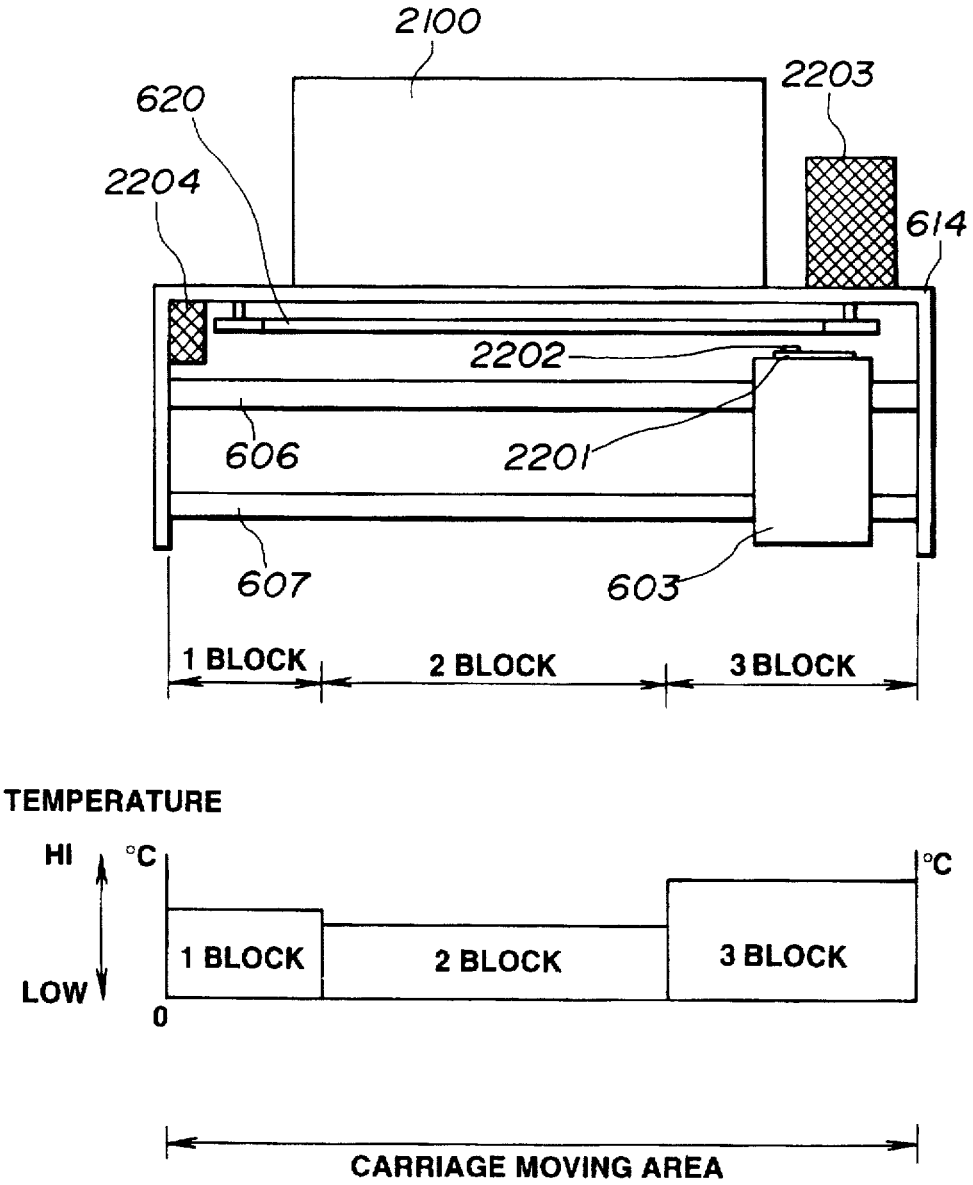
FIG. 21 is a schematic view for explaining a seventh embodiment of the present invention.

For example, as shown in FIG. 21, the moving area of the carriage 603 is divided into a suitable number of blocks along the direction of the movement of the carriage 603.

In this embodiment, the number of the blocks is three. The position where the data is measured can be specified by using the reading element provided on the carriage 603. Then, the data measured in every block is averaged respectively and the average temperature of each block is determined.

The control for driving the print head is carried out in accordance with the determined temperature data.

This means that the ink discharge is controlled in every block in accordance with the temperature data which is determined on the basis of the data measured in every block. That is, when the carriage 603 is positioned and performs ink discharge within one block, the ink discharge condition is controlled in accordance with the temperature determined in the one block.

Figure 22:
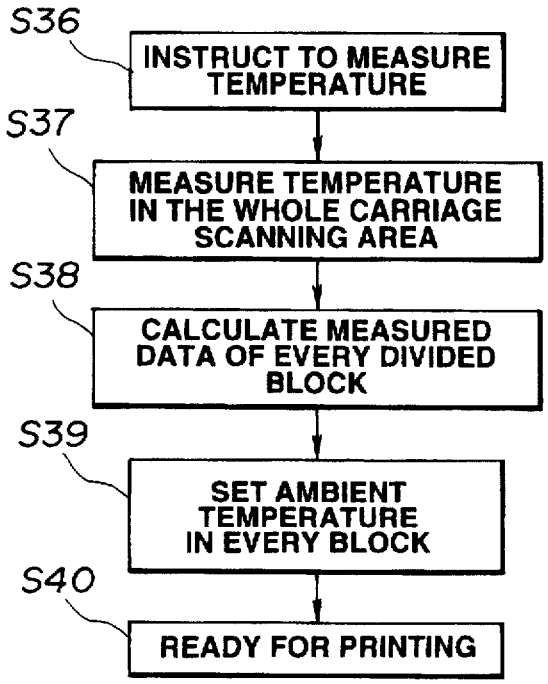
FIG. 22 is a flow chart for explaining the seventh embodiment of the present invention.

FIG. 22 shows a schematic flow-chart of the temperature measurement which is executed by the control unit 630.

When the temperature measurement is instructed (step S36), the temperature is measured along the whole area where the carriage can move for printing (step S37), then the measured temperature data are summed up and averaged in each divided block (step S38), then the ambient temperature of each block is determined on the basis of calculated data (steps S39, S40), and ink discharge is controlled in accordance with the thus determined ambient temperature.

In each embodiment described in the foregoing, a hole can be opened on the housing 614 for radiating heat from the interior of the housing 614 to the open air. Cooling means such as a fan can be provided in order to avoid the temperature rise in the printing apparatus efficiently.

Moreover, for more stable and precise temperature measurement, it is preferable that the temperature measurement is carried out especially at the portion where the cooling means is provided.

The printing method is not limited to the ink jet printing method and other printing methods are also applicable to this invention.

As described hereinbefore, according to the present invention, temperature measurement is effected at the position where the thermal energy from the electrical parts is scarcely transmitted and the measurement is effected considering the influence of the electrical parts which generate thermal energy, whereby the temperature can be precisely measured and stable fine printing can be performed.

The present invention brings about excellent effects particularly in using a print head of the bubble jet system proposed by Canon, Inc., which performs printing by forming fine ink droplets by the use of thermal energy.

As a representative constitution and principle, the basic principle disclosed in, for example, U.S. Pat. Nos. 4,723,129 and 4,740,796 is preferred. Particularly, on-demand type printing is effective because, by applying at least one driving signal which gives rapid temperature elevation exceeding nucleate boiling, electricity-heat converters, arranged corresponding to sheets or liquid channels holding a liquid (ink), generate thermal energy to effect film boiling at the heat acting surface of the recording head. Consequently, bubbles within the liquid (ink) can be formed in one-to-one correspondence to the driving signals. By discharging the liquid (ink) through an opening for discharging by growth and shrinkage of the bubble, at least one droplet is formed. By making the driving signals into desired pulse shapes, growth and shrinkage of the bubbles can be effected in a manner that discharges the liquid (ink) with particularly excellent response characteristics.

As the driving signals of such pulse shapes, those disclosed in U.S. Pat. Nos. 4,463,359 and 4,345,262 are suitable. Further excellent recording can be performed using the conditions described in U.S. Pat. No. 4,313,124 concerning the temperature elevation rate of the above-mentioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution shown in U.S. Pat. No. 4,558,333 or 4,459,600, disclosing the heat acting portion arranged in a flexed region, is also included in the present invention.

In addition, the present invention can also effectively use the constitution disclosed in Japanese Laid-Open Patent Application No. 59-123670, which uses a slit common to a plurality of electricity-heat converters, or Japanese Laid-Open Patent Application No. 59-138461, which has an opening for absorbing a pressure wave from the heat energy corresponding to the discharging portion.

In addition, the present invention is effective for a recording head of the freely exchangeable chip type, which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., is preferable, because the effect of the present invention can be further stabilized. Specific examples of these may include, for the recording head, capping means, cleaning means, pressurization or suction means, electricity-heat converters or another type of heating elements, or preliminary heating means using a combination of these heating devices. It is also effective for ensuring stable recording to perform preliminary ink discharge which involves ink discharging separate from recording.

In addition, although the ink is considered as the liquid in the embodiments as above described, the ink may be in a solid state below room temperature as long as the ink will soften or liquify at or above room temperature, or liquify when a recording signal is applied to it. It is common in such an ink jet device to control the viscosity of the ink to be maintained within a certain range for stable discharge by adjusting the temperature of the ink in a range from 30 to 70° C.

In addition, in order to avoid the temperature elevation due to heat energy by positively utilizing the heat energy as the energy for the change of state from solid to liquid, or to prevent the evaporation of ink by using ink that is solid under normal storage conditions, ink having a property of liquifying only with the application of heat energy, such as liquifying with the application of heat energy in accordance with a recording signal and solidifying prior to reaching a recording medium, is also applicable in the present invention. In such a case, the ink may be held as a liquid or solid in recesses or through holes of a porous sheet, which is placed opposed to the electricity-heat converters, as described in Japanese Laid-Open Patent Application No. 54-56847 or No. 60-71260. The most effective method for the ink as above described in the present invention is based on film boiling.

Additionally, a printing apparatus provided with a recording mechanism using an ink jet printing apparatus according to the present invention may include an image output terminal of an information processing unit such as a computer, as well as a copying machine combined with a reader, etc., and a facsimile machine having a transmission/receiving function.

Figure 23:
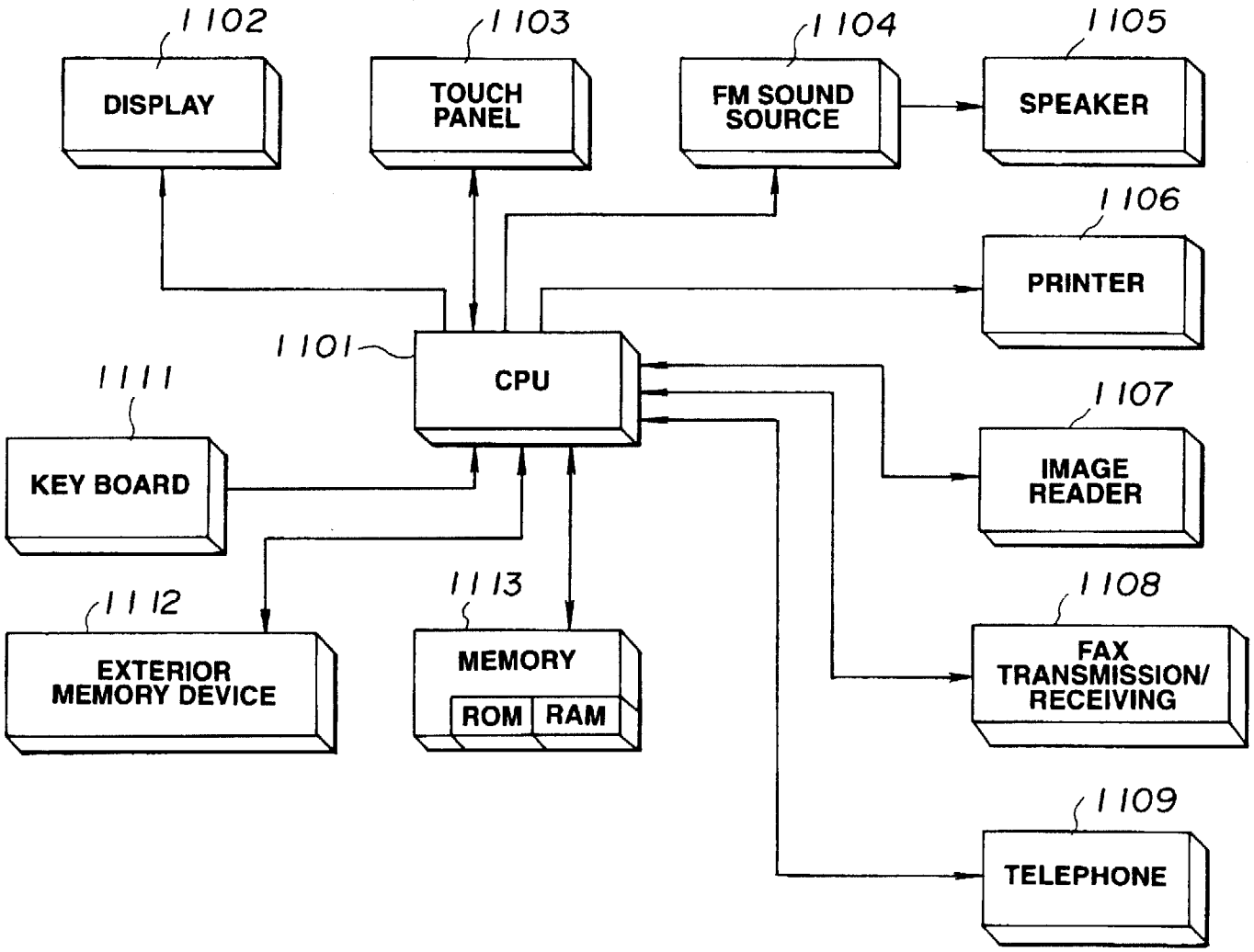
FIG. 23 is a schematic block diagram of an information processing unit to which the present invention can be applied.

FIG. 23 is a block diagram showing a schematic construction of an information processing unit capable of functioning as a word processor, a personal computer, a facsimile machine and copying machine, to which the recording apparatus of the present invention is applied.

In FIG. 23, 1101 denotes a control part for controlling the whole of an apparatus and is provided with a CPU such as a microprocessor and various kinds of I/O parts, and serves to output control signals or data signals to various parts or to input control signals or data signals from various parts. Numeral 1102 is a display using a display image screen on which various types of menus, document information and image data read by an image reader 1107 or the like are displayed. Numeral 1103 is a transparent and pressure sensitive touch panel which is provided on the display 1102 and which an operator uses by depressing the surface with a finger.

Numeral 1104 denotes an FM (frequency modulation) sound source part which stores as digital data music information prepared by a music editor or the like in a memory 1113 or an exterior memory device 1112, reads the information from the memories and performs FM modulation. An electric signal outputted from the FM sound source part 1104 is converted into audible sound by a speaker 1105. A printer part 1106 to which a recording apparatus of the present invention is applied is used as an output terminal of a word processor, a personal computer, a facsimile machine and a copying machine.

Numeral 1107 denotes an image reader, which serves to photoelectrically read input original documents, and can read facsimile originals and copied originals as well as other various kinds of originals. Numeral 1108 designates a transmission/receiving part of a facsimile (FAX), which serves to code and send or to receive and decode facsimile transmissions of the original data read by the image reader 1107 or a transmitted facsimile signal, and is provided with an interface function with an exterior side. Numeral 1109 is a telephone part having a variety of functions, such as operation as an ordinary telephone, a caretaking telephone, etc.

Numeral 1113 designates a memory including a ROM which stores a system program or manager program and other application programs, or character fonts, dictionaries, etc., an application program loaded from the exterior memory device 1112, document information, a video RAM or the like.

Numeral 1111 is a keyboard which serves to input document information, various kinds of commands or the like.

The exterior memory device 1112 uses a floppy disk or a hard disk, etc., as a recording medium that can be loaded with document information, music or sound information or the application program of a user, etc.

Figure 24:
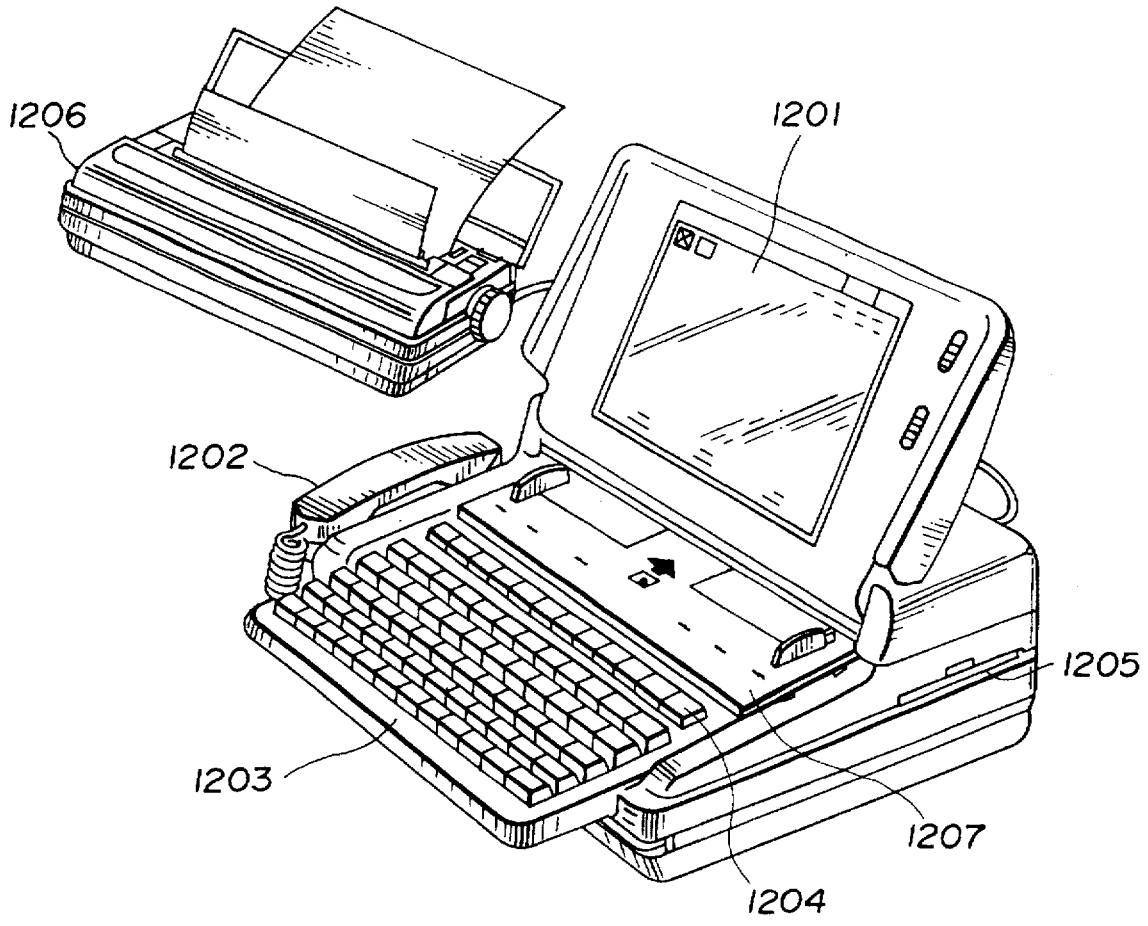
FIG. 24 is a perspective view of the information processing unit shown in block form in FIG. 23.

FIG. 24 depicts a typical information processing unit shown in block diagram form in FIG. 23.

In FIG. 24 1201 is a flat panel display using a liquid crystal device or the like and serves to display various menus or graphic information and document information, etc. The touch panel is disposed on this display 1201 and coordinates can be inputted or items can be specified and inputted through depression of the surface of the touch panel by using a finger. Numeral 1202 is a handset employed when the unit functions as a telephone. A keyboard 1203 is detachably connected to the main body of the information processing unit and is capable of inputting all sorts of document information and different data. Numerous function keys or the like 1204 are included on the keyboard 1203, and numeral 1205 indicates an insert port for inserting a floppy disk into the exterior memory device.

Numeral 1207 designates a paper mounting part for mounting the original to be read by the image reader 1107. The read original is ejected from a back side of the information processing unit. A received facsimile or the like is recorded by an ink jet printer 1206.

The display 1201 may be a CRT type, but is preferably in the form of a flat panel such as a liquid crystal display making use of a ferroelectric liquid crystal, because that way a compact, thin and light display can be obtained.

In the case where the above information processing unit functions as a personal computer or a word processor, various types of information inputted from the keyboard are processed in accordance with a prescribed program by the control part 1101 and outputted to the printer part 1108 as an image.

In the case where the information processing unit operates as a receiver of a facsimile machine, facsimile information inputted from the FAX transmission/receiving part 1108 through a communication line is received and processed by the control part 1101 in accordance with a prescribed program and outputted to the printer part 1106 as a received image.

In the case where the information processing unit serves as a copying machine, an original is read by the image reader 1107 and the read original data is outputted to the printer part 1106 as a copied image through the control part 1101. In the case where the information processing unit functions as a transmitter for the facsimile machine, the original data read by the image 1107 is transmitted and processed by the control part 1101 in accordance with a prescribed program and then transmitted to the communication line through the FAX transmission/receiving part 1108.

Figure 25:
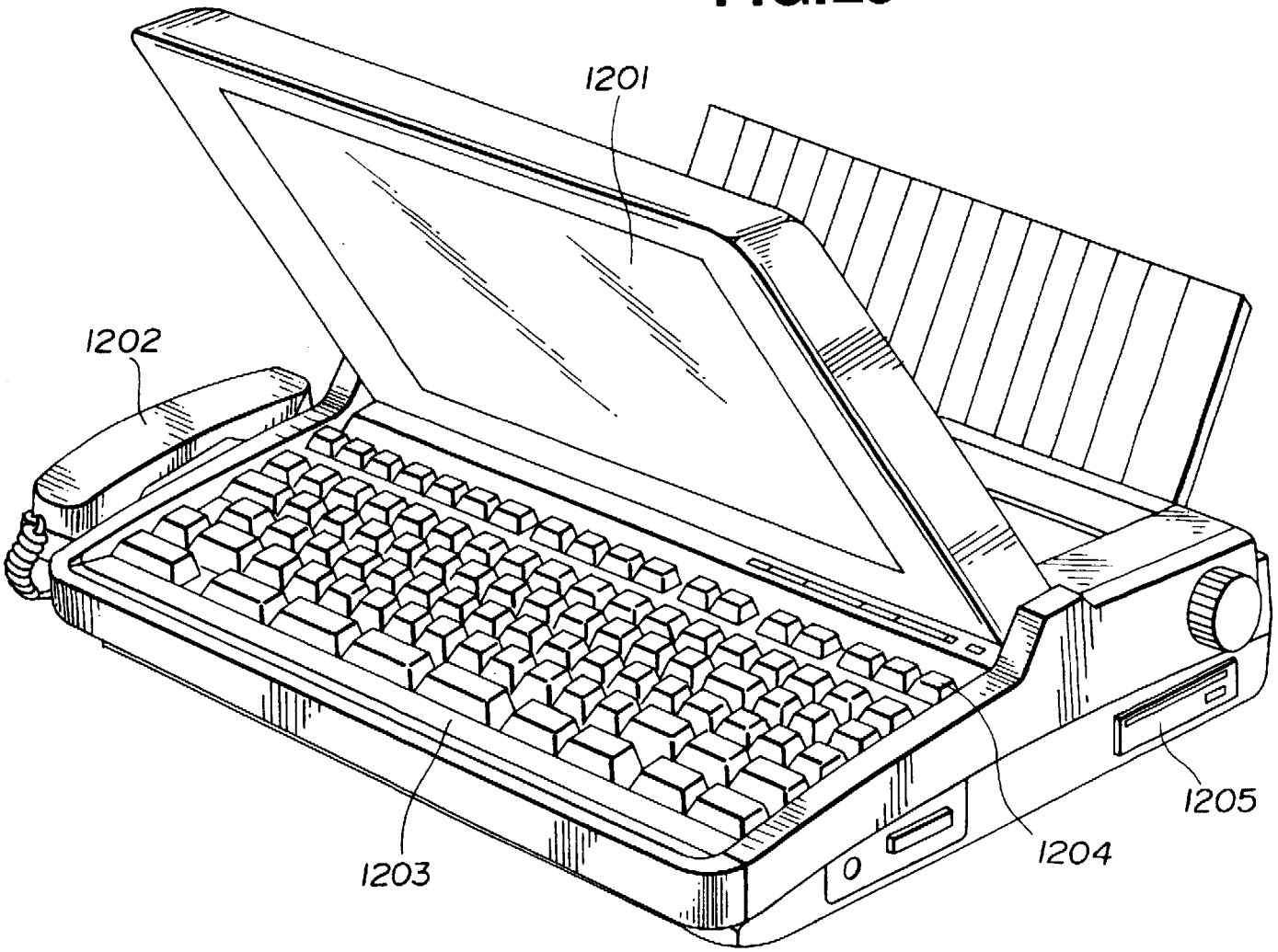
FIG. 25 is a perspective view of a unitary information processing unit.

The information processing unit described above may be a unitary type in which an ink jet printer is built in the main body as illustrated in FIG. 25. In this case, the portability of the information processing unit can be improved. In this figure, portions having the same functions as those in FIG. 24 are marked by corresponding reference numerals.

Since a recorded image of high definition can be obtained by the application of the apparatus of the present invention to the multifunctional information processing unit as set forth above, the functions of the information processing unit can be further enhanced.

It will be appreciated that the present invention has been disclosed in connection with numerous preferred embodiments thereof. Modifications and alternations other than those specifically noted can be made without departing from the spirit or scope of the invention as delineated in the following claims.

What is claimed is:

1. An ink jet printing apparatus for printing an image on a printing medium, said apparatus comprising:

printing means having first temperature measuring means, said printing means being detachably mountable to said apparatus for ejecting ink onto a printing medium;

second temperature measuring means having a degree of precision higher than that of the first temperature measuring means;

correction condition determining means communicating with said second temperature measuring means for determining a condition to correct an output of the first temperature measuring means such that the output of the first temperature measuring means is substantially equal to that of said second temperature measuring means;

correction means for correcting the output of the first temperature measuring means in accordance with the correction condition determined by said correction condition determining means, said correction means comprising an amplifier for amplifying a portion of the output of the first temperature measuring means which is changeable in accordance with temperature change; and control means for controlling the printing means in accordance with an output of the amplifier.

2. An ink jet printing apparatus according to claim 1, wherein the printing means includes electrothermal converters for generating heat energy to eject droplets of ink toward the printing medium.

3. An image forming apparatus for forming an image on a printing medium, said apparatus comprising:

printing means having first temperature measuring means, said printing means being detachably mountable to said apparatus for ejecting ink onto a printing medium;

second temperature measuring means having a degree of precision higher than that of the first temperature measuring means;

correction condition determining means communicating with said second temperature measuring means for determining a condition to correct an output of the first temperature measuring means such that the output of the first temperature measuring means is substantially equal to that of said second temperature measuring means;

correction means for correcting the output of the first temperature measuring means in accordance with the correction condition determined by said correction condition determining means, said correction means comprising an amplifier for amplifying a portion of the output of the first temperature measuring means which is changeable in accordance with temperature change; and control means for controlling the printing means in accordance with the output of the amplifier.

4. An image forming apparatus according to claim 3, further comprising image reading means for reading information from an original image to be printed on the printing medium by the printing means.

5. An image forming apparatus according to claim 3, further comprising image information signal transmitting means for transmitting signals representing the image to be printed on the printing medium by the printing means.

6. An information processing apparatus for printing an image on a printing medium, said apparatus comprising:

printing means having first temperature measuring means, said printing means being detachably mountable to said apparatus for ejecting ink onto a printing medium;

second temperature measuring means having a degree of precision higher than that of the first temperature measuring means;

correction condition determining means communicating with said second temperature measuring means for determining a condition to correct an output of the first temperature measuring means such that the output of the first temperature measuring means is substantially equal to that of said second temperature measuring means;

correction means for correcting the output of the first temperature measuring means in accordance with the correction condition determined by said correction condition determining means, said correction means comprising an amplifier for amplifying a portion of the output of the first temperature measuring means which is changeable in accordance with temperature change;

printing signal input means for inputting printing signals representing an image to be printed on the printing medium by the printing means; and control means for controlling the printing means in accordance with the output of the amplifier and in accordance with the input printing signals.

7. An information processing apparatus according to claim 6, wherein said printing signal input means comprises a keyboard.

8. An ink jet printing method for printing an image on a printing medium using printing means having a first temperature measuring means, said method comprising the steps of:

providing second temperature measuring means having a degree of precision higher than that of the first temperature measuring means;

determining a condition to correct an output of the first temperature measuring means such that the output of the first temperature measuring means is substantially equal to that of the second temperature measuring means;

correcting the output of the first temperature measuring means in accordance with the correction condition determined in said correction condition determining step, said correction step comprising the step of amplifying a portion of the output from the first temperature measuring means which is changeable in accordance with temperature change; and controlling the printing means in accordance with the output of the first temperature measuring means amplified in said amplifying step.

9. An ink jet printing apparatus for printing an image on a printing medium using printing means having a temperature measuring means, said apparatus comprising:

subtracting means for subtracting a predetermined value from an output of the temperature measuring means;

amplifying means for amplifying the subtracted output of the temperature measuring means; and control means for controlling the printing means in accordance with the amplified value amplified by said amplifying means.

10. An ink jet printing apparatus according to claim 9, wherein the printing means comprises electrothermal converters for generating heat energy to eject droplets of ink toward the printing medium.

11. An ink jet printing method for printing an image on a printing medium using printing means having a temperature measuring means, said method comprising the steps of:

subtracting a predetermined value from an output of the temperature measuring means;

amplifying the subtracted output of the temperature measuring means; and printing by controlling the printing means in accordance with the amplified value.

12. An ink jet printing apparatus for printing an image on a printing medium using printing means, said apparatus comprising:

moving means for moving the printing means relatively to the printing medium within a full moving range;

a motor for driving said moving means;

temperature measuring means for measuring ambient temperature, said temperature measuring means moving with the printing means; and control means for controlling the printing means in accordance with an output of said temperature measuring means when said temperature measuring means is within a predetermined range which is shorter than the full moving range of the printing means, wherein the predetermined range is determined so as not to be adjacent said motor.

13. An ink jet printing apparatus according to claim 12, wherein the predetermined range is determined by dividing the full moving range of the printing means into plural areas, and said control means controls the printing means in each of the plural areas.

14. An ink jet printing apparatus according to claim 13, wherein the printing means comprises electrothermal converters for generating heat energy to eject droplets of ink toward the printing medium.

15. An image forming apparatus for forming an image on a printing medium using printing means, said apparatus comprising:

moving means for moving the printing means relatively to the printing medium within a full moving range;

temperature measuring means for measuring ambient temperature, said temperature measuring means moving with the printing means; and control means for controlling the printing means in accordance with an output of said temperature measuring means when said temperature measuring means is within a predetermined range which is shorter than the full moving range of the printing means.

16. An image forming apparatus according to claim 15, further comprising image reading means for reading an original image to be formed on the printing medium by the printing means.

17. An image forming apparatus according to claim 15, further comprising image information signal transmitting means for transmitting signals representing the image to be formed on the printing medium with the printing means.

18. An information processing apparatus for printing an image on a printing medium using printing means, said apparatus comprising:

moving means for moving the printing means relatively to the printing medium within a full moving range;

temperature measuring means for measuring ambient temperature, said temperature measuring means moving with the printing means;

printing signal input means for inputting printing signals representing an image to be printed on the printing medium by the printing means; and control means for controlling the printing means in accordance with an output of said temperature measuring means when said temperature measuring means is within a predetermined range which is shorter than the full moving range of the printing means, and in accordance with the input printing signals.

19. An information processing apparatus according to claim 18, wherein said printing signal input means comprises a keyboard.

20. An ink jet printing method for printing an image on a printing medium using printing means, said method comprising the steps of:

providing temperature measuring means for measuring ambient temperature, the temperature measuring means moving with the printing means within a full moving range; and printing by controlling the printing means in accordance with an output of the temperature measuring means when the temperature measuring means is within a predetermined range which is shorter than the full moving range of the printing means.

* * * * *

UNITED STATES PATENT AND TRADEMARK OFFICE

CERTIFICATE OF CORRECTION

PATENT NO. : 5,764,246 Page 1 of 2

DATED : June 9, 1998

INVENTOR(S) : WATAYA ET AL.

It is certified that error appears in the above-identified patent and that said Letters Patent is hereby corrected as shown below:

On the title page:

[56] References Cited:

U.S. PATENT DOCUMENTS

"Onozano" should read --Onozato--.

FOREIGN PATENT DOCUMENTS

"01290437 11/1989" should read
--1-290437 11/1989--.

"03061048 3/1991" should read
--3-061048 3/1991--.

COLUMN 8:

Line 8, "vf" should read --Vf--.
Line 9, "is" (second occurrence) should be deleted.
Line 26, "nal" should read --nals--.

UNITED STATES PATENT AND TRADEMARK OFFICE

CERTIFICATE OF CORRECTION

PATENT NO. : 5,764,246 Page 2 of 2

DATED : June 9, 1998

INVENTOR(S) : WATAYA ET AL.

It is certified that error appears in the above-identified patent and that said Letters Patent is hereby corrected as shown below:

COLUMN 12:

Line 16, "VF" should read --Vf--.

COLUMN 13:

Line 58, "a" should read --an--.

COLUMN 14:

Line 8, "as" should read --an--.

Signed and Sealed this

Twenty-third Day of February, 1999

*Attest:*

Q. TODD DICKINSON

*Attesting Officer*

*Acting Commissioner of Patents and Trademarks*